US012704030B2

(12) United States Patent
Sladic et al.

(10) Patent No.: US 12,704,030 B2
(45) **Date of Patent: *Aug. 11, 2026**

(54) SCREEN ASSEMBLY HAVING PERMEABLE HANDLING AREA

(71) Applicant: Weatherford Technology Holdings, LLC, Houston, TX (US)

(72) Inventors: John S. Sladic, Katy, TX (US); Stephen McNamee, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/614,660

(22) Filed: Mar. 23, 2024

(65) Prior Publication Data

US 2024/0229610 A1 Jul. 11, 2024

Related U.S. Application Data

(63) Continuation of application No. 16/854,517, filed on Apr. 21, 2020, now Pat. No. 12,006,800.

(51) Int. Cl.

| | |
|---|---|
| ***E21B 19/16*** | (2006.01) |
| ***E21B 43/04*** | (2006.01) |
| ***E21B 43/08*** | (2006.01) |

(52) U.S. Cl.

CPC ..... *E21B 19/16* (2013.01); *E21B 43/045* (2013.01); *E21B 43/086* (2013.01); (Continued)

(58) Field of Classification Search

CPC ..... E21B 19/16; E21B 43/045; E21B 43/086; E21B 43/088; E21B 43/04; E21B 43/08

See application file for complete search history.

(56) References Cited

U.S. PATENT DOCUMENTS

| | | | |
|---|---|---|---|
| 4,506,730 | A | 3/1985 | McCollin et al. |
| 4,770,336 | A | 9/1988 | Arterbury et al. |

(Continued)

FOREIGN PATENT DOCUMENTS

| | | | |
|---|---|---|---|
| WO | 03064811 | A2 | 8/2003 |
| WO | 2004099560 | A1 | 11/2004 |

(Continued)

OTHER PUBLICATIONS

International Search Report mailed Jun. 18, 2021, and issued in counterpart PCT Application No. PCT/US2021/021969.

(Continued)

*Primary Examiner* — Neel Girish Patel

(74) *Attorney, Agent, or Firm* — Cabello Hall Zinda PLLC

(57) ABSTRACT

A gravel pack assembly for a borehole has first and second joints and a foil. The basepipes of the joints connect end-to-end, and both of the basepipes have filters for filtering fluid passage from a borehole into bores of the basepipes. Transport tubes are disposed along the first and second joint, and a jumper tube expands across the connected ends of the basepipes and connects the transport tubes together. The foil encloses an area across the connected ends. The foil has an external surface defining an annulus thereabout with the borehole. The foil has end rings abutting the filters of the joints. At least a section of the foil leaks fluid from the borehole to the area enclosed by the foil, and at least a filter portion of the assembly filters the leaked fluid from the area to at least one of the first and second bores.

20 Claims, 12 Drawing Sheets

(52) U.S. Cl.
CPC ..... *E21B 43/088* (2013.01); *E21B 43/04* (2013.01); *E21B 43/08* (2013.01)

(56) References Cited

U.S. PATENT DOCUMENTS

| | | | | |
|---|---|---|---|---|
| 4,945,991 | A | 8/1990 | Jones | |
| 5,113,935 | A | 5/1992 | Jones et al. | |
| 5,341,880 | A | 8/1994 | Thorstensen et al. | |
| 5,476,143 | A | 12/1995 | Sparlin et al. | |
| 5,515,915 | A | 5/1996 | Jones et al. | |
| 5,868,200 | A | 2/1999 | Bryant et al. | |
| 6,227,303 | B1 | 5/2001 | Jones | |
| 6,405,800 | B1 | 6/2002 | Walker et al. | |
| 6,409,219 | B1 * | 6/2002 | Broome | E21B 43/04 285/124.1 |
| 6,591,916 | B1 * | 7/2003 | Ayling | E21B 21/019 175/218 |
| 6,793,021 | B1 * | 9/2004 | Fanguy | E21B 19/163 166/380 |
| 6,837,308 | B2 | 1/2005 | Michel | |
| 7,497,267 | B2 | 3/2009 | Setterberg, Jr. et al. | |
| 7,918,276 | B2 | 4/2011 | Guignard et al. | |
| 7,971,642 | B2 | 7/2011 | Yeh et al. | |
| 8,245,789 | B2 | 8/2012 | Holderman et al. | |
| 8,281,855 | B2 | 10/2012 | Langlais et al. | |
| 8,511,380 | B2 | 8/2013 | Guignard et al. | |
| 8,919,435 | B2 | 12/2014 | Greci et al. | |
| 9,109,432 | B2 * | 8/2015 | Hansen | E21B 19/08 |
| 9,945,211 | B2 | 4/2018 | McNamee et al. | |
| 12,006,800 | B2 * | 6/2024 | Sladic | E21B 43/086 |
| 2002/0079099 | A1 | 6/2002 | Hurst et al. | |
| 2002/0189809 | A1 | 12/2002 | Nguyen et al. | |
| 2003/0173075 | A1 | 9/2003 | Morvant et al. | |
| 2004/0140089 | A1 | 7/2004 | Gunneroed | |
| 2008/0006402 | A1 * | 1/2008 | Russell | E21B 43/082 166/205 |
| 2009/0095471 | A1 | 4/2009 | Guignard et al. | |
| 2010/0059232 | A1 | 3/2010 | Langlais et al. | |
| 2010/0155064 | A1 * | 6/2010 | Nutley | E21B 43/04 166/278 |
| 2010/0236779 | A1 | 9/2010 | Nutley et al. | |
| 2011/0002410 | A1 | 1/2011 | Forenza et al. | |
| 2011/0139460 | A1 * | 6/2011 | Selstad | E21B 43/12 166/344 |
| 2011/0220347 | A1 | 9/2011 | Kayser | |
| 2011/0303420 | A1 | 12/2011 | Thorkildsen et al. | |
| 2011/0315369 | A1 * | 12/2011 | Holderman | E21B 19/16 285/333 |
| 2012/0018146 | A1 | 1/2012 | Wildhack | |
| 2013/0327542 | A1 * | 12/2013 | Least | E21B 17/02 166/242.6 |
| 2013/0341006 | A1 | 12/2013 | Greci et al. | |
| 2014/0014314 | A1 * | 1/2014 | Cunningham | E21B 43/08 166/51 |
| 2014/0076580 | A1 | 3/2014 | Holderman et al. | |
| 2014/0110131 | A1 * | 4/2014 | Cunningham | E21B 17/1028 166/51 |
| 2014/0131051 | A1 | 5/2014 | Pratt et al. | |
| 2015/0226040 | A1 * | 8/2015 | McNamee | E21B 17/1078 166/278 |
| 2017/0022789 | A1 * | 1/2017 | Hodge | E21B 43/088 |
| 2017/0074077 | A1 | 3/2017 | Bowen et al. | |
| 2017/0211361 | A1 * | 7/2017 | Reid | E21B 43/08 |
| 2018/0371878 | A1 * | 12/2018 | Coffin | E21B 43/14 |
| 2019/0145232 | A1 * | 5/2019 | Sessa | E21B 43/045 166/51 |
| 2020/0340334 | A1 * | 10/2020 | Jarratt | E21B 43/25 |
| 2021/0123327 | A1 * | 4/2021 | Langlais | E21B 17/1078 |

FOREIGN PATENT DOCUMENTS

| | | | |
|---|---|---|---|
| WO | 2007092082 | A2 | 8/2007 |
| WO | 2010028158 | A1 | 3/2010 |
| WO | 2011130122 | A2 | 10/2011 |
| WO | 2013055451 | A1 | 4/2013 |
| WO | 2013187878 | A1 | 12/2013 |
| WO | 2016018821 | A2 | 2/2016 |
| WO | 2017015192 | A1 | 1/2017 |

OTHER PUBLICATIONS

Weatherford, "7.6-30 Hydraulic Tubing Tong," Brochure, copyright 2005-2014, 1-pg.
Weatherford, "Openhole Shunted Screen System," Brochure, copyright 2011.
Weatherford, "RCS Completion Slips," Brochure, copyright 2009-2015, 2-pgs.
Weatherford, "Removable Collar Screen-Handling System," Brochure, copyright 2015, 1-pg.
Weatherford, "Shunt Tube Technology," Brochure, copyright 2011.

* cited by examiner

SCREEN ASSEMBLY HAVING PERMEABLE HANDLING AREA

CROSS-REFERENCE TO RELATED APPLICATIONS

This application is a continuation of U.S. application Ser. No. 16/854,517 filed Apr. 21, 2020, which is incorporated herein by reference in its entirety.

BACKGROUND OF THE DISCLOSURE

A wellscreen may be used on a production string in a hydrocarbon well and especially in a horizontal section of the wellbore. Typically, the wellscreen has a perforated basepipe surrounded by a screen that blocks the flow of particulates into the production string. Even though the screen may filter out particulates, some contaminants and other unwanted materials can still enter the production string.

To reduce the inflow of unwanted contaminants, operators can perform gravel packing around the wellscreen. In this procedure, gravel (e.g., sand, proppant, etc.) is placed in the annulus between wellscreen and the wellbore by pumping a slurry of carrier fluid and gravel down a workstring and redirecting the slurry to the annulus with a crossover tool. As the gravel fills the annulus, it becomes tightly packed and acts as an additional filtering layer around the wellscreen to prevent the wellbore from collapsing and to prevent contaminants from entering the production string.

Ideally, the gravel uniformly packs around the entire length of the wellscreen, completely filling the annulus. However, during gravel packing, the slurry may become more viscous as carrier fluid is lost into the surrounding formation and/or into the wellscreen. Sand bridges can then form where the fluid loss occurs, and the sand bridges can interrupt the flow of the slurry and prevent the annulus from completely filling with gravel.

As shown in FIG. 1A, for example, a wellscreen 20 is positioned on production tubing 15 disposed in a wellbore 14 adjacent a hydrocarbon bearing formation. A packer 18 may be used on the production tubing 15 to seal the annulus 16 between the wellscreen 20 and the wellbore 14. Proppant, sand, or particulate material (collectively referred to as "gravel" G) and a carrier fluid are pumped as a slurry down a workstring. The gravel G pumped in the slurry down the workstring passes through a crossover tool 17 and fills an annulus 16 around the wellscreen 20.

The carrier liquid in the slurry normally flows into the formation and/or through the wellscreen 20 itself. However, the wellscreen 20 is sized to prevent the gravel from flowing through the wellscreen 20. This results in the gravel being deposited or "screened out" in the annulus 16 between the wellscreen 20 and the wellbore 14 to form a gravel-pack around the wellscreen 20. The gravel, in turn, is sized so that it forms a permeable mass (i.e., a gravel pack) that allows produced fluids to flow through the mass and into the wellscreen 20 but blocks the flow of particulates into the wellscreen 20.

As the slurry flows, the formation may have an area PA of highly permeable material, which draws liquid from the slurry. In addition, fluid can pass through the wellscreen 20 into the interior of the production tubing 15 and then back up to the surface. As the slurry loses fluid at the permeable area PA and/or the wellscreen 20, the remaining gravel G may form a sand bridge B that can prevent further filling of the annulus 16 with gravel G. Such bridges B block further flow of the slurry through the annulus 16, thereby preventing the placement of sufficient gravel G below the bridge B in top-to-bottom packing operations or above the bridge B in bottom-to-top packing operations.

To overcome sand-bridging problems, shunt tube systems, such as shown in FIGS. 1B-1C, have been developed to create an alternative route for gravel G around areas where sand bridges B may form. Shunt tube systems are used frequently in gravel packing horizontal, open hole wells. The system uses transport tubes and pack tubes placed along the wellscreen 20 to divert gravel pack slurry past premature bridging or obstructions in the wellbore 14. The tubes allow the gravel pack slurry to continue to gravel pack the well further downhole.

Current shunt tube systems used for open hole gravel packing operation may have two transport tubes and two pack tubes that provide individual flow paths for the gravel pack slurry. These tubes are located external to the sand screen. For example, FIGS. 1B-1C are schematic views of examples of wellscreens 20*a-b* provided with shunt tubes 40*a-b* and pack tubes 50. In the wellscreen assembly 10, a first wellscreen 20*a* is coupled to a second wellscreen 20*b*, and each has a basepipe 22*a-b* joined together with a coupling 30 to define a production string. The wellscreens 20*a-b* have screens 24*a-b* with filter media that surround the basepipes 22*a-b*. The wellscreen assembly 10 also includes shunt tubes 40*a-b* and pack tubes 50, which can be steel tubes having substantially rectangular cross-section. The shunt tubes 40*a-b* are supported on the exterior of the wellscreens 20*a-b* and provide an alternate flow path. The pack tubes 50 communicate off the shunt tubes 40*a-b* and have nozzles or exit ports 52 to distribute slurry in the gravel pack operation adjacent the screens 24*a-b*.

To communicate the alternate path from slurry between the adjacent wellscreens 20*a-b*, jumper tubes 44 are disposed between the shunt tubes 40*a-b* and connected with connectors 42. In this way, the shunt tubes 40*a-b* and the jumper tubes 44 maintain the flow path outside the length of the wellscreen assembly 10, even if a borehole's annular space is bridged, for example, by a loss of integrity in a part of the formation.

As shown in FIGS. 1B-1C, the wellscreen assembly 10 for an open hole completion typically has main shrouds 26*a-b* that extend completely over the screens 24*a-b* and provide a protective sleeve for the filter media and shunt tubes 40*a-b* and pack tubes 50. The shrouds 26*a-b* have apertures to allow for fluid flow. The main shrouds 26*a-b* terminate at the support rings 28*a-b*, which supports ends of the shrouds 26*a-b* and have passages for the ends of the shunt tubes 40*a-b*. For a cased hole completion, the wellscreen assembly 10 may lack these shrouds.

Either way, the shunt tubes 40*a-b* stop at a certain length from the ends of the wellscreens 20*a-b* to allow handling room when the wellscreens 20*a-b* are joined together with the coupling 30 at the rig. Once the wellscreens 20*a-b* are joined, their respective shunt tubes 40*a-b* are linearly aligned, but there is still a gap between them. Continuity of the shunt tubes' flow path is typically established by installing the short, pre-sized jumper tubes 44 in the gap.

Each jumper tube 44 may use connectors 42 at each end that contains a set of seals and is designed to slide onto the end of the jumper tubes 44 in a telescoping engagement. When the jumper tube 44 is installed into the gap between the shunt tubes 40*a-b*, the connectors 42 are driven partially off the end of the jumper tube 44 and onto the ends of the shunt tube 40*a-b* until the connectors 42 are in a sealing engagement with both shunt tubes 40*a-b* and the jumper tube 44.

There may be a concern that debris or protruding surfaces of the wellbore can dislodge the connectors 42 from sealing engagement with the tubes 40*a-b* and 44 while running the wellscreen assembly 10 into the wellbore. Therefore, a device called a split cover 34 as shown in FIG. 1B may typically be used to protect the connectors 42 and jumper tubes 44. The split cover 32 is a piece of thin-gauge perforated tube, essentially the same diameter as the main shrouds 26*a-b* of the wellscreen assembly 10, and the same length as the gap between the support rings 28*a-b*. The perforated cover 32 is split into halves with longitudinal cuts, and the halves are rejoined with hinges along one seam and with locking nut and bolt arrangements along the other seam. The split cover 32 can be opened, wrapped around the gap area between the wellscreens 20*a-b*, and then closed and secured with the locking bolts so the wellscreen assembly 10 can run downhole.

Typically, the split cover 32 is perforated with large openings that do not inhibit movement of the gravel and slurry. Primarily, the split cover 32 acts as a protective shroud so that the wellscreen assembly 10 does not get hung up on the support rings 28*a-b* when running in hole or so the jumper tubes 44, connectors 42, and shunt tubes 40*a-b* are not damaged during run in.

As noted, proppant or gravel in gravel pack or frac pack operations is placed along the length of a sand face completion whether it is open hole or cased hole. To place the gravel in a gravel pack operation, the carrier fluid carries the gravel to the sand face to pack the void space between the sand face and the sand screens 24*a-b*. In a frac pack operation, the carrier fluid carriers the gravel to fracture the reservoir rock and to increase the sand face/gravel contact area. Then, the annular space is packed with the gravel between the cased or open hole and the sand screens 24*a-b*.

To leave a fully supported gravel pack in the annulus, the carrier fluid dehydrates and leaves the gravel in a fully supported position. Depending on the operation, dehydration occurs through the reservoir sand face into the reservoir and/or through the wellscreens 20*a-b* and up the production tubing. When fluid dehydrates through the wellscreens 20*a-b*, there must be an adequate open area that provides access to flow paths allowing the carrier fluid to return up the well.

Most wellscreen assemblies 10 have blank areas or gaps 60 near the basepipe connections where the wellscreens 20*a-b* are made up when running in hole. These blank areas 60 on the wellscreen assembly 10 provide no open area for fluid dehydration. Consequently, gravel pack settling is unstable in these blank areas 60, creating unstable pack sections around the sand screens' blank area 60 having voids or space. Gravel that has been packed uphole might eventually migrate or shift due to fluid flow and gravity. This shifting can expose sections of the screen and may lead to a loss of sand control.

During gravel packing of the assemblies of FIGS. 1A-1C, gravel slurry can readily communicate around the blank area between the support rings 28*a-b* on the basepipes 22*a-b*. For example, the slurry can readily enter through the shroud 32, end of pack tube 50, etc. and can collect in the blank area 60 between the support rings 28*a-b* around the basepipes 22*a-b* and the coupling 30. The slurry becomes trapped in the blank area 60 because the gravel cannot dehydrate, and the carrier fluid cannot return uphole.

This can lead to failure to achieve a complete gravel pack because it is more difficult for the gravel pack slurry to dehydrate over the non-permeable section in the blank area 60 between the deployed wellscreens 20*a-b*. As noted, the primary non-permeable sections of the wellscreens 20*a-b* are usually blank areas 60 used for pipe handling such as required when moving wellscreens 20*a-b* on the rig and when making the connections to run-in hole. Blank areas 60 can also be used for centralizers (not shown) that are used to centralize the wellscreens 20*a-b* and keep them concentric in casing or open hole.

Incomplete gravel packs may result in loss of sand control. Additionally, as the industry has become more automated, tongs and slips are used more frequently when running wellscreens 20*a-b* into the well. This handling equipment requires more handling room on the wellscreens 20*a-b*, which reduces the available permeable area of the screens 24*a-b*.

In one technique to deal with these issues for open hole, operators accept that the annulus 16 between the wellbore 14 and screens 24*a-b* will not pack completely. However, operators attempt to control the gravel pack process in such a way that the coverage of the permeable screens 24*a-b* can be more complete. The wellbore 14 is then expected to fill the voids in the annulus 16 after the gravel pack operation.

In cased wells that are often vertical or less than 45-degrees deviated, it is believed that gravity may assist the gravel pack process and help the gravel pack sand settle and create a complete pack. Historically, cased hole gravel pack screens 24*a-b* offered maximum permeable area on the basepipe 22*a-b* but at the expense of handling room for power tongs. The screen length was short with few connections, and the screen weight was not designed to be very heavy so less efficient make up processes were needed to make connections that did not require much handling room.

In another technique to deal with these problems, a leak-off system can extend over the blank area 60 of the wellscreens 20*a-b* to allow fluid to dehydrate through the leak-off system from the non-permeable blank area 60 to the permeable screens 24*a-b*. As shown in FIG. 1B, for example, a leak-off tube 46 can be positioned in this blank area 60 between the support rings 28*a-b*. The leak-off tube 46 has openings (not shown) along it that allow the carrier fluid to enter the tube 46 from the slurry in the blank area 60. The tube 46 then communicates the leaked carrier fluid to the screens 24*a-b*, which allows the gravel to dehydrate in the blank area 60. Although the leak-off tube 46 may be effective to some extent to dehydrate slurry in the blank area 60, better distribution of gravel is desired in both open and cased holes to improve sand control.

To that end, the subject matter of the present disclosure is directed to overcoming, or at least reducing the effects of, one or more of the problems set forth above.

SUMMARY OF THE DISCLOSURE

According to the present disclosure, a completion assembly is assembled by grips of rig components at a rig. The completion assembly is configured to position in a borehole. The assembly comprises a plurality of wellscreens. Each of the wellscreens comprises a basepipe, and each of the basepipes define a bore.

Each of the basepipes comprises ends, an intermediate section, and a primary filter. The ends are configured to couple adjoining ones of the basepipes together. The intermediate section is disposed between the ends and defines a plurality of intermediate perforations in communication with the bore. The primary filter is disposed at the intermediate section and is configured to filter communication from the borehole to the intermediate perforations. The ends of the adjoining ones of the basepipes coupled together defining a blank area between the primary filters.

At least one of the wellscreens comprises a plurality of end perforations, which are defined in at least one of the ends and are disposed in communication with the bore. The at least one end comprises a foil and a gripping section.

The foil is disposed adjacent the end perforations and is configured to filter communication from the blank area to the bore. The gripping section is disposed adjacent the end perforations and is configured to be gripped by one of the grips of the rig components in assembling the completion assembly.

In one arrangement of the assembly, wherein each of the basepipes can comprise: support rings disposed on the ends of the basepipe, each of the support rings defining one or more passages; and one or more transport tubes disposed along the basepipe and extending between the one or more passages in the support rings. The assembly can further comprise one or more jumper tubes disposed across the blank annular area between the ends of the adjoining ones of the basepipes and connecting the one or more transport tubes together. Each of the basepipes can comprise a shroud disposed along the basepipe and extending between the support rings, the shroud defining a plurality of flow openings therethrough.

In another arrangement of the assembly, the at least one foil can comprise a secondary filter disposed about the end perforations on the at least one end of the at least one basepipe and being supported with end rings affixed to the at least one basepipe at the at least one end. The secondary filter can be configured to filter communication from the blank annular area to the end perforations. The gripping section can comprise a sleeve disposed about the secondary filter and being supported on the end rings. The sleeve can define a plurality of flow openings configured to communicate the blank annular area with the secondary filter.

For this arrangement, the flow openings can comprise perforations defined through the sleeve or slots defined along the sleeve.

For this arrangement, each of the basepipes can comprise: support rings disposed on the ends of the basepipe, each of the support rings defining one or more passages; and one or more transport tubes disposed along the basepipe and extending between the one or more passages in the support rings. The support ring on at least one end can be disposed in abutment between one of the end rings of the secondary filter and another end ring of the primary filter or is disposed in spaced relation relative to one of the end rings of the secondary filter.

In yet another arrangement of the assembly, the at least one foil can comprise a sleeve disposed on the at least one end of the at least one basepipe about the end perforations. The sleeve can define a plurality of elongated slits communicating therethrough, and the sleeve can provide an exterior gripping surface for the gripping section. The sleeve can comprise edges welded to the at least one end of the at least one basepipe. An interior of the sleeve can comprise a plurality of channels defined longitudinally therealong. The elongated slits can be defined circumferentially about the sleeve, longitudinally along the sleeve, or a combination thereof.

In another arrangement of the assembly, the at least one foil can comprise a plurality of plugs disposed in the end perforations. The plugs can be configured to filter communication from the blank annular area to the end perforations. The gripping section can comprise a sleeve disposed on the at least one end of the at least one basepipe and having flow openings exposed to the end perforations. The plugs are recessed in the flow openings, and the sleeve provides an exterior gripping surface for the gripping section.

In this arrangement, the sleeve can comprise edges welded to the at least one end of the at least one basepipe. Each of the plugs can comprise: a support ring affixed to the at least one basepipe; and an insert disposed in the end perforation and supported by the support ring, wherein the insert comprises a secondary filter.

In yet another arrangement of the assembly, the at least one foil can comprise a secondary filter disposed inside the bore of the at least one end. The gripping section comprises an exterior gripping surface provided on the at least one end of the at least one basepipe.

In this arrangement, the secondary filter can comprise a screen comprising wire wrapped about ribs disposed longitudinally inside the bore of the at least one end. The secondary filter can be disposed inside the bores of the ends of the adjoining ones of the basepipes coupled together. The secondary filter can comprise end caps disposed respectively in the bores, each of the end caps disposed between an end of the secondary filter and a shoulder in the bore of the adjoining ones of the basepipes coupled together.

In the assembly, the primary filter can comprise a screen disposed on the basepipe, the screen comprising wire wrapped about ribs disposed longitudinally along the basepipe. In the assembly, each of the primary filters can filter carrier fluid from a slurry communicated in the borehole and can hold gravel from the slurry in the annulus at least adjacent the primary filters. The at least one foil can filter the carrier fluid from the slurry communicated in the borehole and can hold the gravel from the slurry in the blank annular area at least adjacent the at least one foil. Finally, the gripping section can provide a uniform outer dimension against which the gravel is held in the blank annular area.

According to the present disclosure, a method is used for running wellscreens from a rig into a borehole. The rig has at least one grip of a rig component. Each of the wellscreens has a basepipe, and each basepipe has a primary filter disposed about intermediate perforations defined in the basepipe between ends of the basepipe.

The method comprises: supporting a first of the wellscreens at the rig; making up a second of the wellscreens to the first wellscreen at the rig by connecting the ends of the first and second wellscreens together; and passing the first and second connected wellscreens downhole from the rig. At least one of the steps of supporting the first wellscreen and making up the second wellscreen to the first wellscreen comprises gripping the at least one grip of the rig component on a gripping section disposed adjacent end perforations on at least one of the ends of at least one of the basepipes, the gripping section having foil disposed adjacent the end perforations, the foil being configured to filter communication through the end perforations.

Supporting the first wellscreen at the rig can comprise gripping completion slips for the at least one grip of the rig component on the gripping section disposed adjacent the end perforations on the end of the basepipe of the first wellscreen; and/or can comprise engaging a collar on a shoulder on the end of the basepipe of the first wellscreen; and supporting the collar on a table at the rig.

The method can further comprise connecting one or more jumper tubes between opposing ends of one or more transport tubes disposed along the first and second wellscreens.

Passing the first and second connected wellscreens downhole from the rig can comprise passing the first and second connection wellscreens from the rig at least until the end of the second wellscreen is at the rig. The steps of supporting and making up can be repeated to connect a third wellscreen to the second wellscreen.

In the method, making up the second wellscreen to the first wellscreen can comprise gripping a first jaw of a first tong as the at least one grip of the rig component on the gripping section disposed adjacent the end perforations on the end of the basepipe of the second wellscreen. Here, connecting the ends of the first and second wellscreens together can comprise gripping a second jaw of a second tong on a coupling attached to the end of the first wellscreen, and tightening the end of the basepipe of the second wellscreen to the coupling by rotating the second wellscreen with the first tong.

The method can also comprise preassembling, before running from the rig, each of the wellscreens to have the primary filter disposed about the intermediate perforations defined in the basepipe between the ends of the basepipe. This preassembling can comprise preassembling the at least one end of the at least one basepipe to have the gripping section and the foil adjacent the end perforations. The step of preassembling the at least one end of the at least one basepipe to have the gripping section and the foil adjacent the end perforations can comprise one of: assembling a secondary filter as the foil on the at least one end and disposed about the end perforations, and supporting a sleeve as the gripping section on the at least one end and disposed about the secondary filter; forming slits in a sleeve, the slits configured to filter therethrough, and affixing the sleeve on the at least one end about the end perforations; and forming openings in a sleeve, affixing the sleeve on the at least one end with the end perforations exposed to the openings, and affixing secondary filters adjacent the end perforations and recessed in the openings of the sleeve.

In the method, making up the second wellscreen to the first wellscreen can comprise making up the first and second wellscreens with a secondary filter as the foil inserted in the bore of the at least one end. Gripping the at least one grip of the rig component on the gripping section disposed adjacent end perforations on the at least one end of the at least one of the basepipe can comprise gripping the at least one grip of the rig component on an external gripping surface of the at least end.

The method can further comprise: running the first and second wellscreens into the borehole; conducting a slurry of carrier fluid and gravel into a portion of an annulus of the borehole around the first and second wellscreens; filtering the carrier fluid from the slurry in the portion of the annulus into a bore of the basepipes of the first and second wellscreens though the primary filters; leaking the carrier fluid from the slurry in a blank annular area between the ends of the first and second wellscreens by filtering the carrier fluid through the foil adjacent the end perforations; and foiling the gravel from the slurry in the blank annular area about the gripping section on the at least one end.

The foregoing summary is not intended to summarize each potential embodiment or every aspect of the present disclosure.

DETAILED DESCRIPTION OF THE DISCLOSURE

Figure 1A:
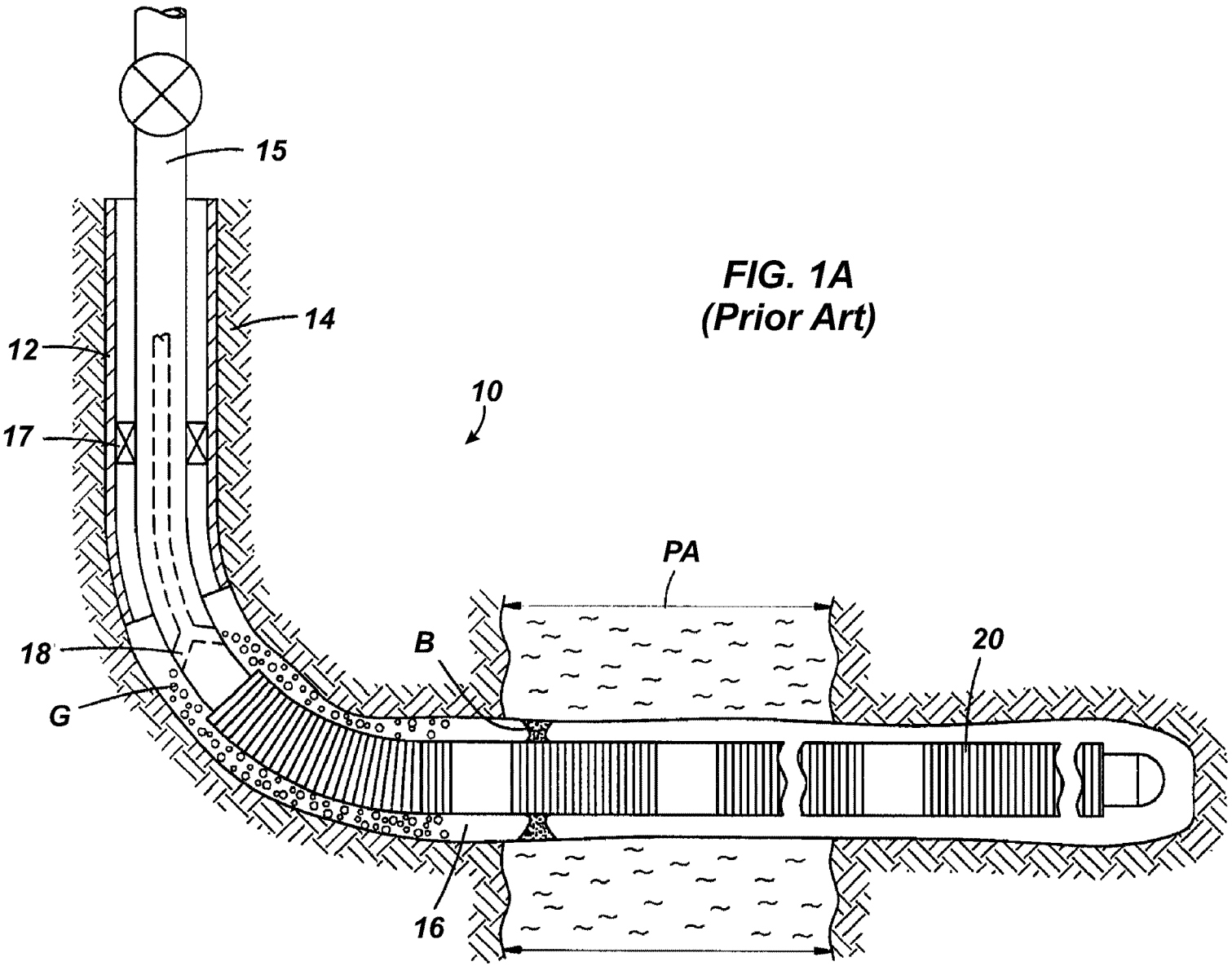
FIG. 1A (Prior Art)
FIG. 1A is a side view, partially in cross-section, of a horizontal wellbore with a wellscreen assembly therein.
Figure 1B:
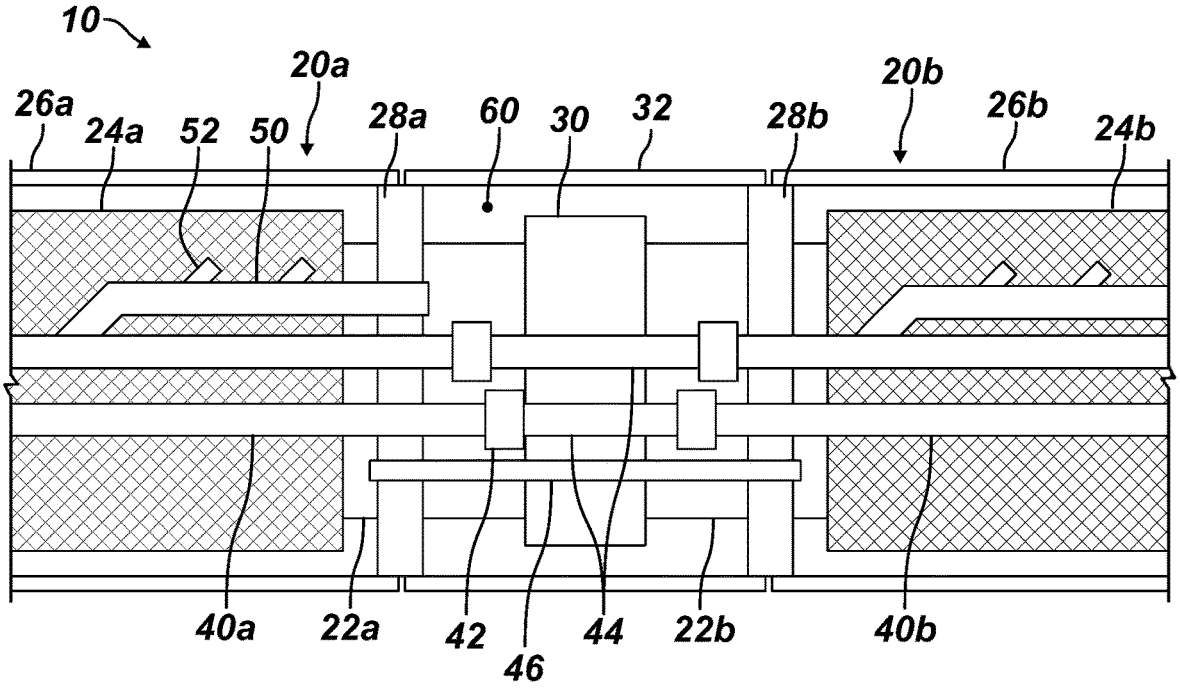
FIG. 1B (Prior Art)
FIG. 1B illustrates a side view of an open hole wellscreen assembly according to the prior art for an open hole.
Figure 1C:
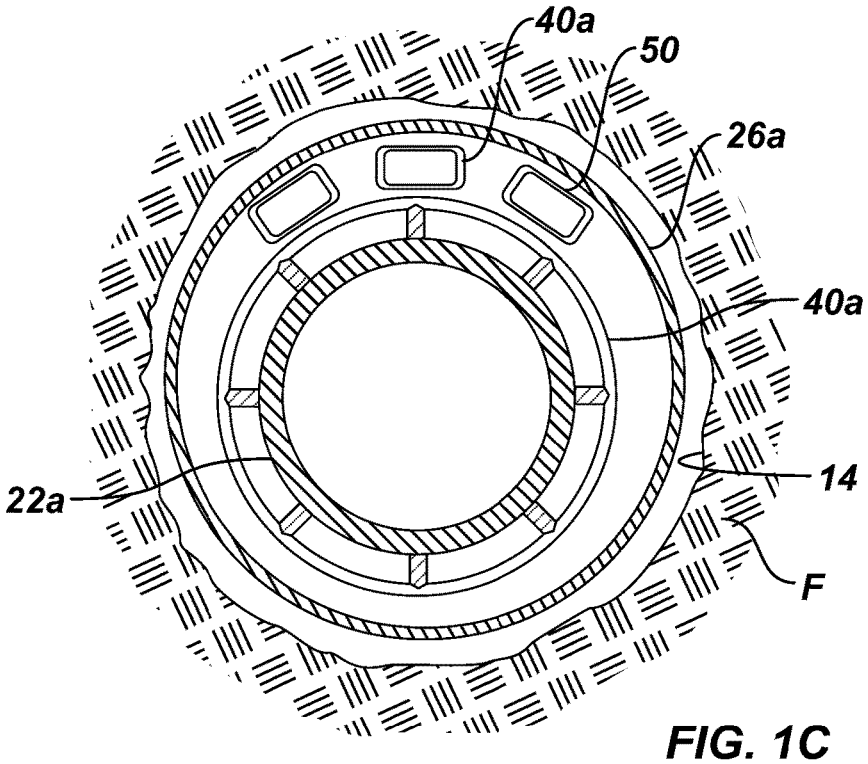
FIG. 1C (Prior Art)
FIG. 1C illustrates an end view of the open hole wellscreen assembly of FIG. 1B.
Figure 2A:
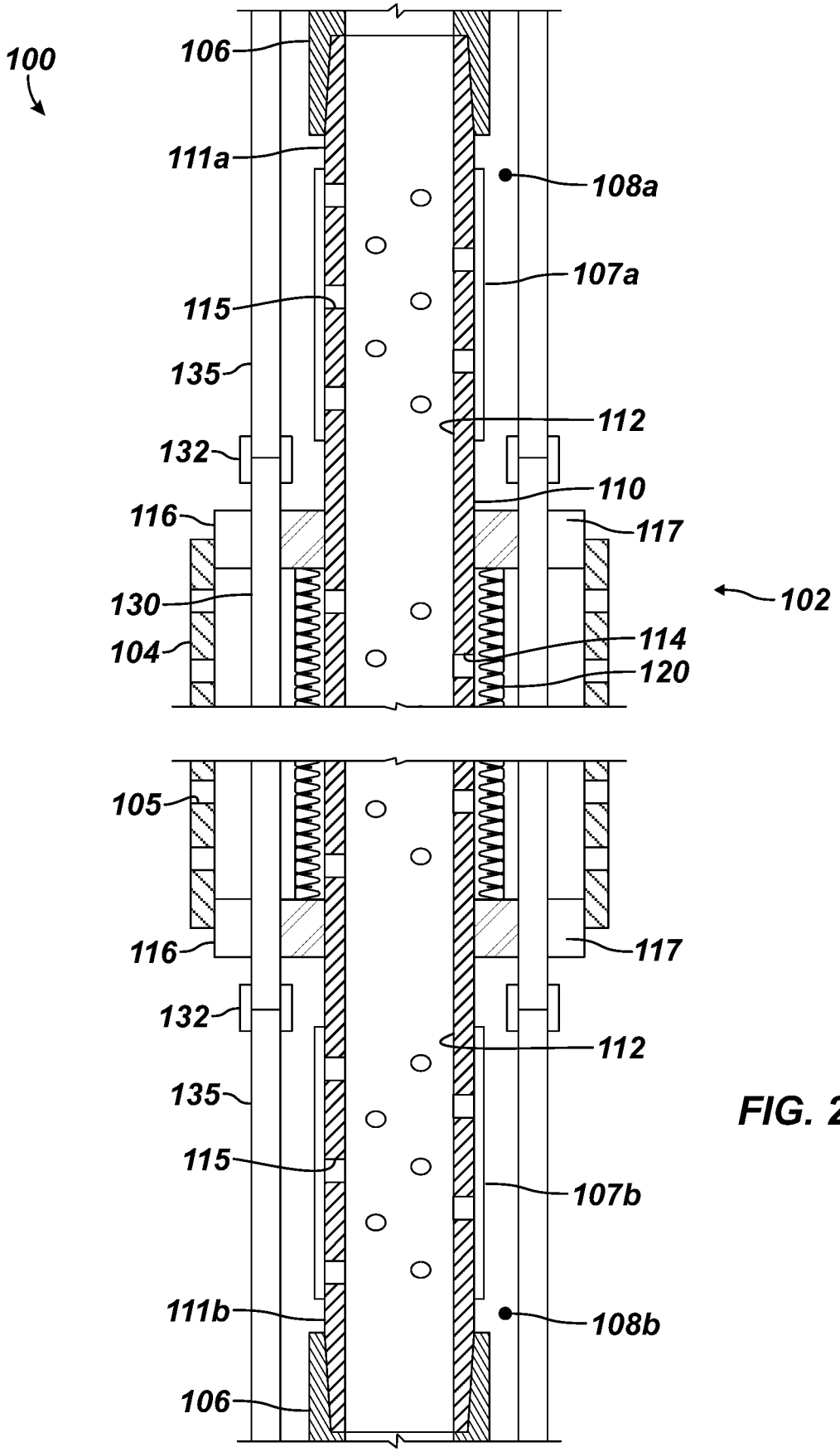
FIG. 2A illustrates a wellscreen assembly according to the present disclosure in cross-section.

FIG. 2A schematically illustrates a wellscreen assembly 100 according to the present disclosure in cross-section. The wellscreen assembly 100, which can be a downhole/sand screen assembly, has a joint, tubular, or basepipe 110 that longitudinally couples to other tubulars and assemblies (not shown) to create a completion string for running in a borehole (not shown).

The basepipe 110 defines a bore 112 for conveying production fluids once the assembly 100 is installed in the borehole. Ends 111*a-b* of the basepipe 110 are configured to couple to the basepipes (not shown) of other assemblies using couplings 106. For example, threads on the ends 111*a-b* of the basepipe 110 couple together with threaded couplings 106 to join the wellscreen assembly 100 with other wellscreen assemblies or tubulars. Typically, a completion has multiple wellscreen assemblies 100 connected in series by such couplings 106 to form a completion string for use in a cased or open borehole (not shown).

An intermediate section 102 of the assembly 100 is disposed on the basepipe 110 between the ends 111*a-b*. The intermediate section 102 defines a plurality of intermediate perforations 114 in communication with the bore 112. A primary filter 120 is disposed about the basepipe 110 at the intermediate section 102 and is configured to filter communication from a borehole annulus to the basepipe's bore 112 through the intermediate perforations 114. The primary filter 120 can include any type of filter media for use downhole, including metal mesh, pre-packed screens, protective shell screens, wire screen, or filters of other construction. As shown here, the primary filter 120 can be a wire-wrapped screen.

Shunt or transport tubes 130 can run along the length of the primary filter 120 and can deliver or transport slurry in an alternate path during gravel pack or frack pack operations. Support rings 116 support the transport tubes 130 at the opposing ends of the wellscreen assembly 100 and hold the shunt tubes 130 in place. For example, each support ring 116 can define one or more passages 117 through which ends of one or more transport tubes 130 disposed along the basepipe 110 extend. Although not shown, pack tubes can communicate off the transport tubes 130 in the intermediate section to deliver slurry around the filter 120. These pack tubes can also exit at passages 117 of the support ring 116. As is known, such pack tubes communicate with the transport tubes 130 and receive portion of the transported slurry. The pack tubes (140) have exits or nozzles along their length to distribute the slurry along the primary filters 120. Slurry may also exit the open end of the pack tube into the blank annular area 108.

Ends of the transport tubes 130 extend from the support rings 116, and jumper tubes 135 are disposed inside a blank annular area 108*a-b* between the coupled ends 111*a-b* of the basepipe 110 to interconnect the ends of the transport tubes 130 on the adjoining assemblies (not shown) together across the couplings 106. Connectors 132 having seals can connect the ends of the jumper tube 135 with the ends of the transport tubes 130.

A shroud 104 can be disposed along the basepipe 110 and can extend between the support rings 116 to cover the primary filter 120. The shroud 104 typically defines a plurality of coarse flow openings 105 therethrough. Such a shroud 104 may be preferred when the assembly 100 is used in an open hole.

At least one of the ends 111*a-b* of the basepipe 110 defines a plurality of end perforations 115 in communication with the blank annular area 108*a-b*. Additionally, at least one permeable gripping section 107*a-b* is disposed on the at least one end 111*a-b* at the end perforations 115. As shown here, both ends 111*a-b* include perforations 115 and permeable gripping section 107*a-b*, but other arrangements are possible.

The size, number, and distribution of the perforations 115 are configured to provide enough fluid flow from the blank annular area 108*a-b* for the purposes of leak off of carrier fluid, but are configured to retain the integrity of the basepipe 110*a-b* for handling and running in a completion string.

As noted in more detail below, the at least one permeable gripping section 107*a-b* is configured to filter communication from the blank annular area 108*a-b* into the end perforations 115. As also noted below, an external surface of the at least one permeable gripping section 107*a-b* is configured to be handled by mechanical grips of pipe handling components, such as completion slips, jaws of a tong device, slips of an elevator, and the like (FIG. 2B), used to connect the basepipe 110 of the assembly 100 to the basepipes of other assemblies on a rig. The permeable gripping section 107*a-b* can be reinforced to facilitate engagement with the mechanical grips (e.g., slips and jaws (FIG. 2B)).

Figure 2B:
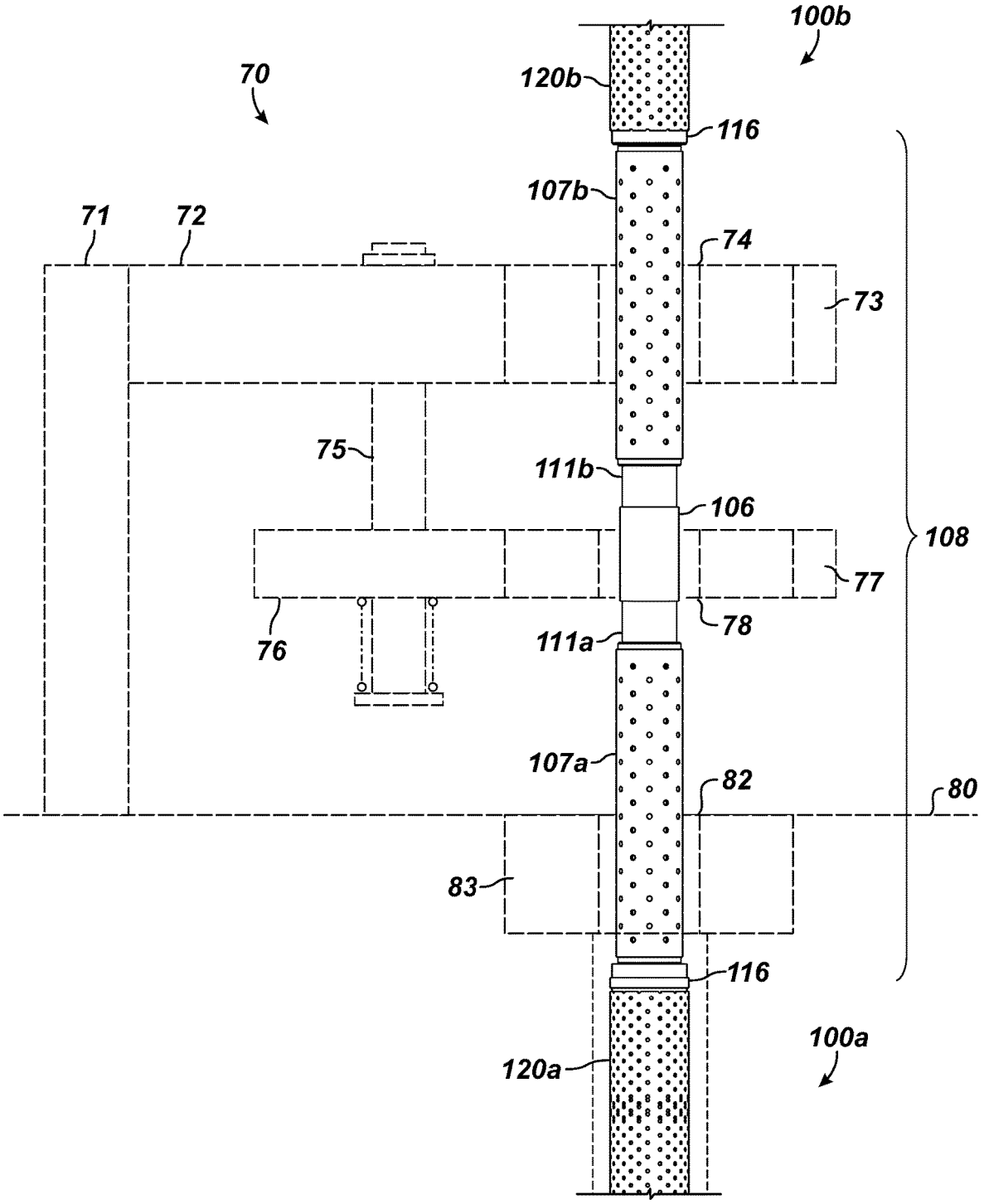
FIG. 2B illustrates the wellscreen assemblies according to the present disclosure being connected together at a rig floor using mechanical grips of pipe handling components.

FIG. 2B illustrates two wellscreen assemblies 100*a-b* according to the present disclosure being connected at a rig floor 80 using a tong device 70, completion slip 82, elevator (not shown), and other rig components for handling pipe. As will be appreciated, various types of tong device 70 can be used to make up the connection of the wellscreen assemblies 100*a-b*. As diagrammed here, the tong device 70 includes a power tong 72 and a backup tong 76 operatively connected by a carriage assembly 55. A hydraulic lift stand 71 may be connected to the power tong 72, with the carriage assembly 75 being supported by the power tong 72 and with the backup tong 76 being supported by the carriage assembly 75. The lift stand 71 can move the tong device 70 on the rig floor 80 relative to the assemblies 100*a-b*. For its part, the carriage assembly 75 can change the separation between the power tong 72 and the backup tong 76 so the vertical distance between them can be adjusted to the assemblies 100*a-b* to be connected.

The power tong 72 includes two or more sections movable relative to each other to open and close a central opening 73. A rotor (not shown) disposed in the power tong 72 is coupled to a motor assembly (not shown), and jaws 74 are attached to the rotor. During operation, the jaws 74 of the power tong 72 can move radially being driven hydraulically to secure against (grip) and release from an end 111*b* of a wellscreen's tubular, a coupling 106, or the like and to accommodate tubulars of various diameters. With the jaws 74 secured against the tubular's end 111*b*, the jaws 74 rotate with the rotor to rotate the wellscreen assembly 100*b* about a longitudinal axis during make up and break out of a tubular connection.

As shown, the backup tong 76 is disposed underneath the power tong 72 in a manner so that a longitudinal axis extends through the central openings 73, 77 of the power tong 72 and backup tong 76. Similar to the power tong 72, the backup tong 76 can include two or more sections movable relative to each other to open and close the central opening 77. The backup tong 76 also further includes jaws 58 that can be driven hydraulically to secure against (grip) and release from an end 111*a* of a wellscreen's tubular, a coupling 106, or the like and to accommodate tubulars of various diameters.

To run the wellscreen assemblies 100*a-b* in the borehole, a first (lower) one of the wellscreen assemblies 100*a* can be supported in completion slips 82 of the rig floor 80. In particular, the completion slips 82 can be used to grip directly on a reinforced external surface of a permeable gripping section 107*a* disposed about end perforations (115) on the wellscreen's end 111*a*. Gripping of other portions of the wellscreen assembly 100*a*, such as the shroud, filter 120*a*, and the like are not possible to support the weight of the wellscreen assembly 100*a* and any connected completion string.

The first wellscreen assembly 100*a* can have the coupling 106 already made up on the end 111*a*. A second (upper) one of the wellscreen assemblies 100*b* is then made up to the first wellscreen assembly 100*a* by threading its end 111*a* to the coupling 106. Handling of this upper wellscreen assembly 100*b* involves gripping an upper end (not shown) of this wellscreen assembly 100*b* using an elevator (not shown).

Different types of elevator can be used for handling the wellscreen assemblies 100*a-b*, including collar-type and slip-type elevators. The slip-type elevator can grip directly on a reinforced external surface of an upper permeable gripping section 107*a* disposed on the upper end 111*a* of the wellscreen assemblies 100*a-b*. The collar-type elevator may use features of the coupling 106 to support handling the wellscreen assemblies 100*a-b*.

As an alternative, a collar system can be used in the handling of the wellscreens 100*a-b*. An example of such a collar system is disclosed in U.S. Pat. No. 10,337,263, which is incorporated herein by reference. The collar system includes an application-specific collar (not shown), a sliding collar table 83 at the rig floor 80, and a hydraulically operated automated side-door (ASD) elevator (not shown). The collar fits on the upper end 111*a* of the wellscreen assemblies 100*a-b* and acts as the interface between basepipe 110 and handling equipment. The sliding collar table 82 has a larger pass-through diameter to enable the pass-through of completion assemblies. The elevator engages the collar to handle the wellscreen assemblies 100*a-b*, and the collar is landed onto the sliding collar table 83. The elevator is opened, and the next connection is picked up and made up to the string. Once the connection is done, the sliding collar table 83 is opened, and the completion string is lowered into the well.

Either way, the tong device 70 can be used to tighten the connection between the wellscreen assemblies 100*a-b*. In particular, once the connection is initially made, the ends 111*b* of the wellscreen assembly 100*b* and the coupling 106 are then gripped using mechanical jaws 74, 78 of the tong device 70. As noted previously, the tong device 70 includes power and backup tongs 72, 76 that can have their separation adjusted and that can be moved horizontally on the rig floor 80 to fit the wellscreen assemblies 100*a-b* and coupling 106 through their central openings 73, 77. The tongs' mechanical jaws 74, 78 can then be hydraulically driven to secure against (grip) and tighten the assemblies 100*a-b* and coupling 106 together. As will be appreciated, alternative steps and an alternative order of steps can be performed to make up the connection between the ends 111*a-b* and coupling 106.

As noted, at least one of the mechanical jaws 74, 78 can grip on a reinforced external surface of a permeable handling or gripping section 107*a-b* disposed about end perforations (115) on at least one of the ends 111*a-b*. As noted, the permeable gripping section 107*a-b* is configured to filter communication to the end perforations (115). As shown here, both ends 111*a-b* may have a permeable gripping section 107*a-b* that can be gripped with the mechanical jaws 74, 78, elevators, completion slips 82, etc.

Using the tong device 70, the connection of the ends 111*a-b* of the wellscreen assemblies 100*a-b* by the coupling 106 is then tightened. For example, the end 111*a* of the lower wellscreen assembly 100*a* can be held stationary with the completions slips 82 that engages the gripping section 107*a*. The backup tong 76 can grip the coupling 106 with its jaws 78, and the power tong 72 can grip the gripping section 107*b* with its jaws 54. By operating the tong device 70, the end 111*b* of the upper wellscreen assembly 100*b* can be rotated with the mechanical jaws 54 that engage the gripping section 107*b* to make up the connection to the coupling 106.

Once tightened to the proper torque, the mechanical jaws 54, 58 are released, and the tong device 70 is moved away. Further steps can then be performed. In particular, one or more jumper tubes (135) can be connected between opposing ends of one or more transport tubes (130) disposed along the wellscreens 100*a-b* that extend from the support rings 116. An intermediate shroud (not shown) can be placed in the blank area 108 between the support rings 116. For example, a cylindrical shroud (not shown) can slide down the upper wellscreen assembly 100*b* and can be affixed to the support rings 116, such as by threading to the support rings 116 or affixing to the support rings 116 with set screws, cap screws, or the like (not shown). Alternatively, a split cover shroud can be positioned in the blank area 108, enclosed around the connection, and affixed to the support rings 116.

The completion slips 82 can be released, and the connected wellscreens 100*a-b* can then be passed through the rig floor 80 until the end of the second wellscreen assembly 100*b* is at the rig floor 80. At this point, the assembly steps can be repeated to connect another wellscreen assembly (100) or a tubing stand to the completion string being run in the borehole.

Having an understanding of the wellscreen assembly 100 according to the present disclosure with its at least one permeable gripping section 107, discussion now turns to particular embodiments of the present disclosure.

Figure 3A:
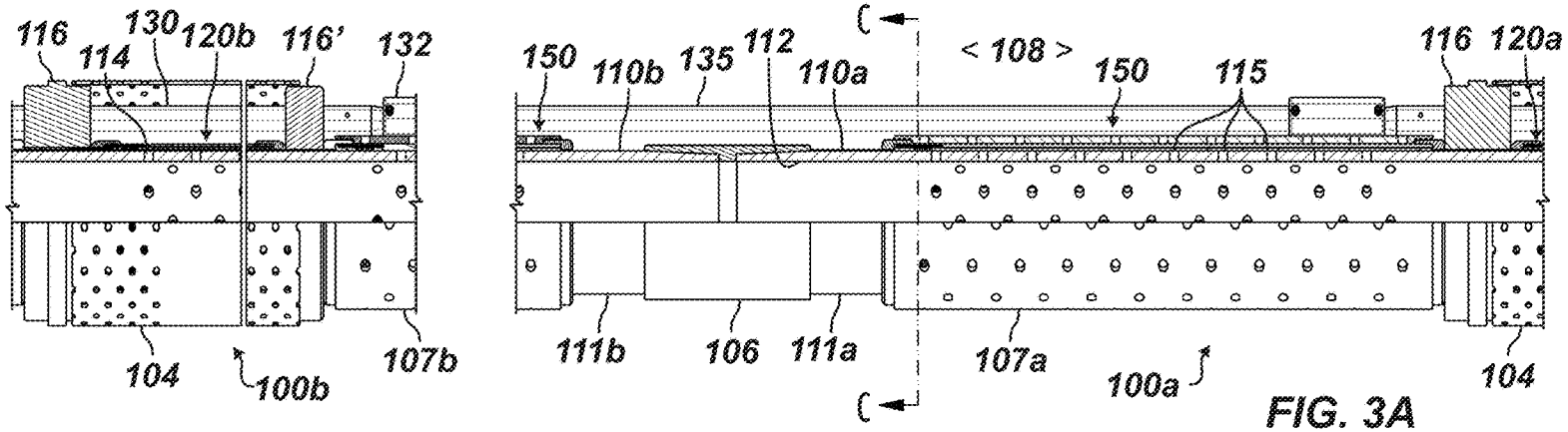
FIG. 3A illustrates a wellscreen assembly according to a first embodiment of the present disclosure in partial cross-section.
Figure 3B:
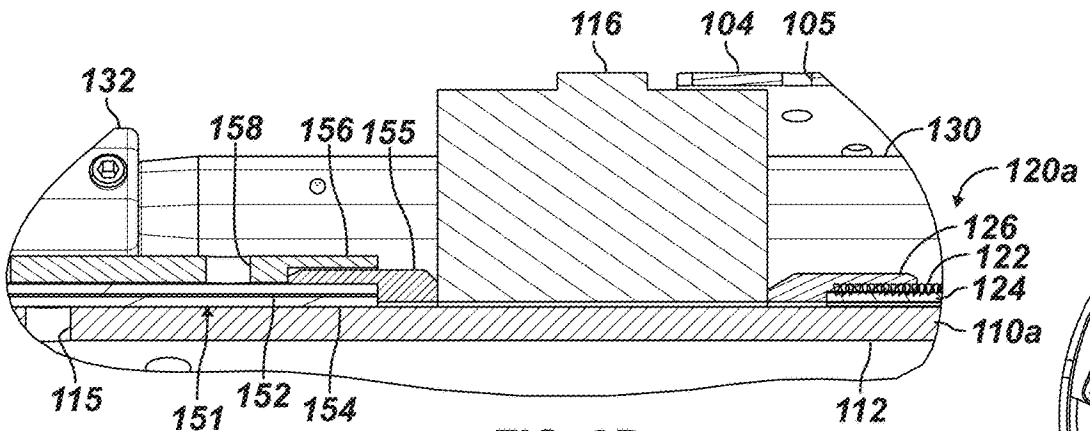
FIG. 3B illustrates a detailed cross-section of a portion of the wellscreen assembly in FIG. 3A.
Figure 3C:
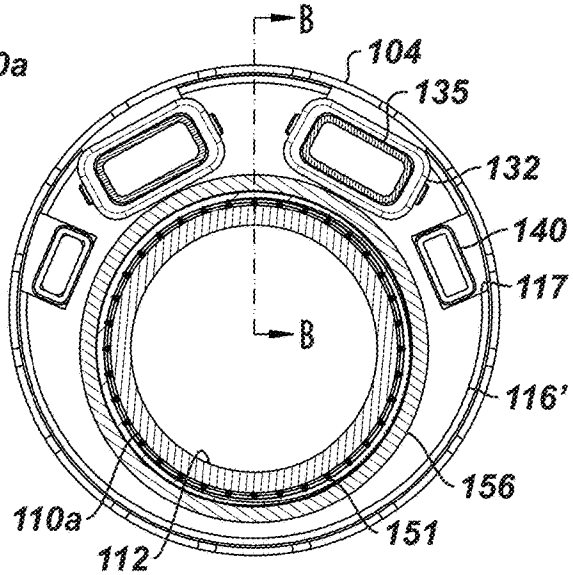
FIG. 3C illustrates an end-section of the wellscreen assembly in FIG. 3A.

FIG. 3A illustrates wellscreen assemblies 100*a-b* according to a first embodiment of the present disclosure in partial cross-section. FIG. 3B illustrates a detailed cross-section of a portion of the wellscreen assembly 100*a* in FIG. 3A. Meanwhile, FIG. 3C illustrates an end-section of the wellscreen assembly 100*a* in FIG. 3A.

In FIG. 3A, two wellscreen assemblies 100*a-b* are being coupled together using a coupling 106 connecting the ends 111*a-b* of the assemblies' basepipes 110*a-b* together as before. Like reference numerals are used in FIGS. 3A-3C for comparable components to the arrangement in FIG. 2A.

As before, each of the assemblies 100*a-b* includes a basepipe 110*a-b* having a primary filter 120*a-b* disposed about the intermediate perforations 114 in the basepipe 110*a-b*. As shown here, the primary filters 120*a-b* on the assemblies 100*a-b* include wire-wrapped screens. For example, the primary filter 120*a* in FIG. 3B includes a wire 122 wrapped about (and welded to) ribs 124 that run longitudinally along the outside of the basepipe 110*a*. End rings 126 affixed to the basepipe 110*a* hold the ends of wire-wrapped screen for the primary filter 120*a* on the basepipe 110*a*. In use, the primary filters 120*a-b* filter fluid communication from the borehole annulus outside the basepipe 110*a-b* into the intermediated perforations 114 of the basepipe 110 that communicate with the bore 112.

As before, each of the assemblies 100*a-b* includes support rings 116, 116' disposed thereon for supporting shrouds 104. In FIG. 3A, two types of support rings 116, 116' can be provided for the shrouds 104 that run along the primary filters 120*a-b* of the basepipes 110*a-b*. One (lower) support ring 116 at one end of the blank area 108 is shown in FIG. 3A, while the other (upper) support ring 116' at the other end of the blank area 108. The support rings 116, 116' can be affixed to the basepipes 110*a-b* with welding or the like, as part of the assembly process of the joint before connections are made at the rig. The support rings 116, 116' can have openings (117) for passage of the ends of the transport tubes 130. One support ring 116 has ledges on opposing sides of a rim against which ends of shrouds 104 can abut. The other support ring 116' has a unitary ledge without a rim, which can enable shrouds 104 to be passed over the ring 116' during assembly.

As before, each of the assemblies 100*a-b* includes shunt tubes 130 that are supported along the primary screens 120*a-b*. As shown in FIG. 3C, for example, the support ring 116' includes slots or openings 117 for passage of the one or more transport tubes 130. In general, the assembly 100 can have any number of transport tubes 130, and the tubes 130 may transport the slurry further along the assemblies 100*a-b* to other locations. As shown here, the assembly 100 can include two transport tubes 130 for transporting slurry for gravel packing. Connectors 132 are provided for connecting ends of the shunt tubes 130 to jumper tubes 135 that extend across the blank area 108 between the assemblies 100*a-b*.

Additionally, the assembly 100 can also include two pack tubes 140 for dispersing slurry during gravel pack operations. These pack tubes 140 can be used to deliver slurry out of nozzles (not shown) adjacent the primary filters (120*a-b*) of the wellscreens 100*a-b*. As shown in FIG. 3C, ends of pack tubes 140 can exit at passages 117 of the support ring 116'. As is known, such pack tubes 140 communicate with the transport tubes 130 to receive portion of the transported slurry, and the pack tubes 140 have exits or nozzles along their length to distribute the slurry along the primary filters 120*a-b*. Slurry may also exit the open ends of the pack tubes 140 into the blank annular area 108.

As noted previously, the wellscreen assemblies 100*a-b* have permeable gripping sections 107*a-b* where leak-off fluid can be filtered from the blank annular area 108 between the connected ends 111*a-b* of the basepipes 110*a-b* and where mechanical grips (e.g., slips, jaws, and the like (FIG. 2B)) can engage and handle the basepipes 110*a-b* during assembly at the rig. In the present embodiment, the permeable gripping sections 107*a-b* include reinforced foils 150 disposed about the surfaces of the basepipes 110*a-b* at the ends 111*a-b* near where the coupling 106 is made.

Both ends 111*a-b* of the connected basepipes 110*a-b* may have a reinforced foil 150 as shown. Alternatively, one reinforced foil 150 may be provided at one end 111*a-b* and not the other of the connected basepipes 110*a-b*. As best shown in FIG. 3A, the reinforced foils 150 are disposed between the support rings 116, 116' and in the blank area 108 between the connected ends 111*a-b*, and the reinforced foils 150 cover portions of the blank ends 111*a-b* of the basepipes 110*a-b* where the coupling 106 connects the basepipes 110*a-b* together.

As disclosed herein, these reinforced foils 150 are configured to filter fluid communication from the borehole annulus (and annular blank area 108) through the end perforations 115 and into the bores 112 of the basepipes 110*a-b*. For example, the reinforced foils 150 at least partially include secondary filters 151. Other arrangements can be used.

The fluid communication through the foils 150 is first used for leak-off of carrier fluid in the slurry used to gravel pack about the wellscreen assemblies 100*a-b* so that the blank annular area 108 can be more evenly packed with gravel. The fluid communication through the reinforced foils 150 may then also provide additional production flow into the bore 112 once the assemblies 100*a-b* are packed in the borehole with annular gravel pack.

As also disclosed herein, these reinforced foils 150 are also configured for handling the wellscreen assemblies 100*a-b* during assembly steps. In particular, the reinforced foils 150 provide reinforced areas or surfaces on the ends 111*a-b* of the basepipes 110*a-b* for engagement by grips (e.g., slips, jaws, and the like (FIG. 2B)). As will be appreciated with the benefit of the present disclosure, the foils 150 are suited for the typical gripping and handling forces encountered when handling the wellscreens 100*a-b* and running in hole.

Accordingly, the reinforced foils 150 provide a leak-off path and provide a reinforced gripping surface for the assemblies 100*a-b* when used in gravel pack and frac pack operations. The foils 150 are already affixed to the basepipes 110*a-b* before handling, before the connections are made up between the adjoining wellscreen assemblies 100*a-b*, and before the jumper tubes 135 have been installed. In fact, the foils 150 are preassembled on the basepipes 110*a-b* along with the primary filters 120*a-b*, support rings 116, and the like.

In the present embodiment and as best shown in FIG. 3B, the foil 150 includes a secondary filter 151 disposed about the end perforations 115 on the pipe end 111*a-b*. The secondary filter 151 can include any type of filter media for use downhole, including metal mesh, pre-packed screens, protective shell screens, wire screen, or filters of other construction. As shown here, the secondary filter 151 can include a wire-wrapped screen having wire 154 disposed about (and welded to) ribs 152 extending longitudinally along the surface of the pipe end 111*a-b*. The secondary filter 151 is supported with end rings 155 affixed (welded) to the pipe end 111*a-b*. The external surface of the at least one foil 150 includes a sleeve 156 supported on (and welded to) the end rings 155 about the secondary filter 151. The sleeve 156 defines a plurality of flow openings 158 configured to communicate the blank annular area 108 with the secondary filter 151. The sleeve 156 and end rings 155 can help distribute handling loads to the basepipe 110*a* and away from the filter 151.

As shown in FIGS. 3A-3B, these flow openings 158 in the foils 150 can include perforations defined through the sleeve 156. To control leak-off and production, the screening provided by the secondary filters 151 of the foils 150 can be the same as or different from the screening provided by the primary filters 120*a-b*, which are used for production. In this regard, the secondary filters 151 of the foils 150 may be wire-wrapped screens or the like and may have gaps or slots to prevent passage of gravel. However, the size of the wire, the number of gaps, the number of slots, etc. may differ from that used on the primary filters 120*a-b*.

Alternatively, the amount of surface area for screening provided by the secondary filters 151 of the foils 150 may be configured to be less than provided by the primary filters 120*a-b*. In this way, using any of these various differences, the foils 150 can provide leak-off capabilities during gravel pack operations, but wellbore fluids would tend to flow more preferentially through the primary filters 120*a-b* during production operations due to the greater amount of open surface area of the primary filters 120*a-b*. Other configurations can be used and can be configured for a particular implementation.

As noted herein, the disclosed assemblies 100*a-c* are disposed in a borehole with gravel packed in the annulus. Gravel, proppant, or the like is packed in the annulus between the assemblies 100*a-b* and the borehole. As the slurry travels in the annulus, the return fluid leaks off through the primary filters 120*a-b* to pack the gravel about the primary filters 120*a-b*.

The foils 150 cover the blank connection in the annular area 108 between the basepipes 110*a-b*. In addition to providing a gripping surface for gripping and handling the basepipes 110*a-b*, the foils 150 provides a surface to hold or retain the gravel in the annular space between the foils 150 and the borehole. As will be appreciated with the benefit of the present disclosure, the foils 150 are suited for the typical gripping and handling forces encountered when handling the wellscreens 100*a-b* and running in hole.

As best shown in the detail of FIG. 3B, the foil 150 can abut the support ring 116 on the basepipe 110*a-b*, just as the primary filter 120*a-b* can abut the support ring 116. In particular, the end ring 126 of the primary filter 120*a* can be welded to the basepipe 110*a*, and the support ring 116 can be welded to the basepipe 110*a* against the end ring 126. The foil's end ring 155 can be welded to the basepipe 110*a* against the support ring 116.

The wellscreen assembly 100*a-b* provides more open area for the gravel to dehydrate. Additionally, the foils 150 provides an external tubular wall on the assembly 100*a-b* that can help the gravel packing to be more uniform at the coupling 106. The external tubular wall of the foils 150 may be concentric or eccentric to the primary filter 120 and to the surrounding borehole. Either way, the external tubular wall of the foil 150 provides a consistent annular space to fill with gravel with reduced variations that could cause premature bridging in the casing and/or open hole. In this way, the foils 150 provide a secondary sand control function for the standard screens of the primary filters 120*a-b*.

Figure 4A:
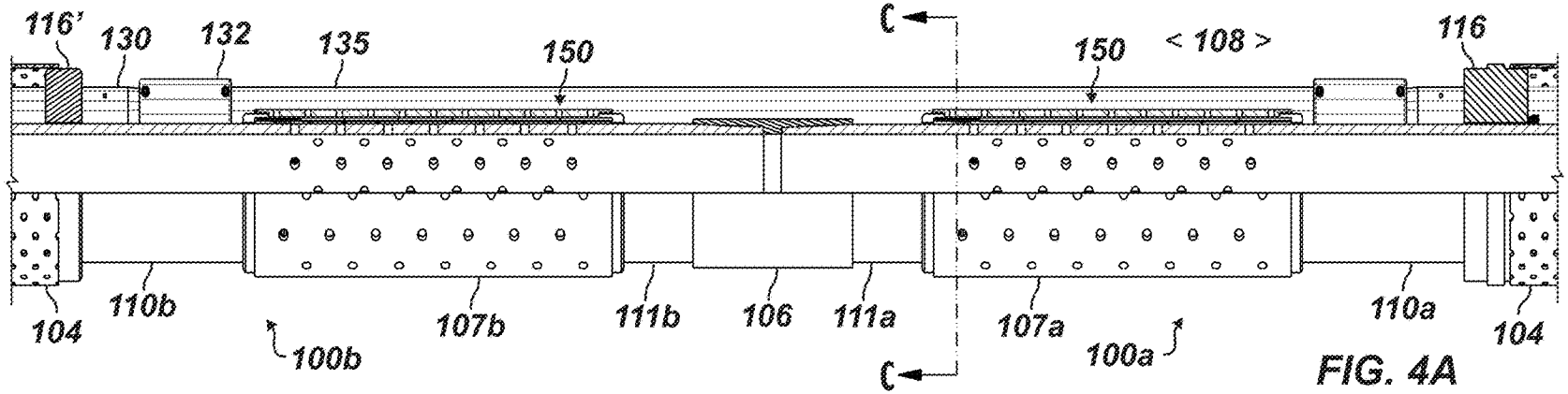
FIG. 4A illustrates a wellscreen assembly according to a second embodiment of the present disclosure in partial cross-section.
Figure 4C:
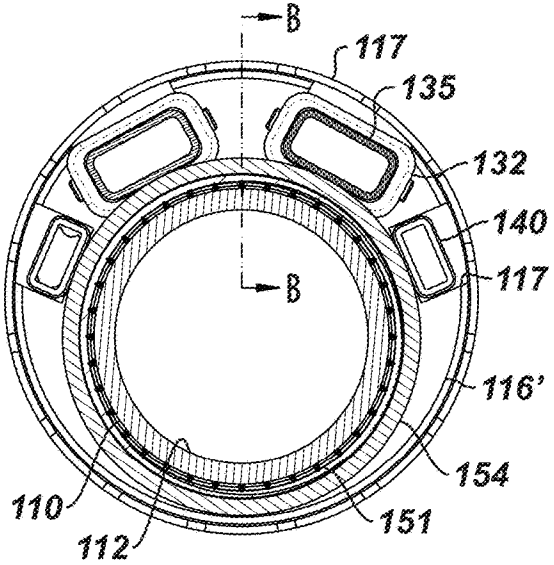
FIG. 4C illustrates an end-section of the wellscreen assembly in FIG. 4A.
Figure 4B:
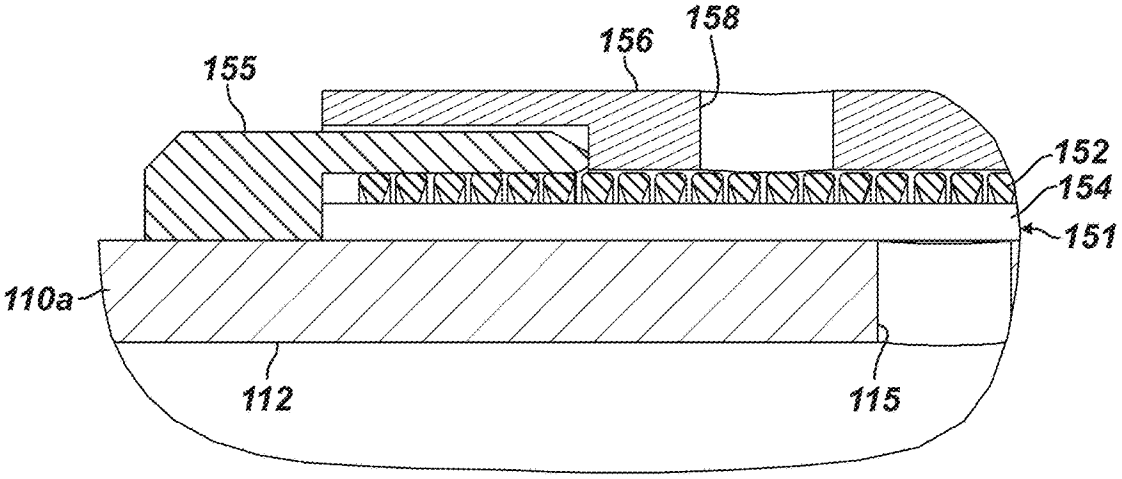
FIG. 4B illustrates a detailed cross-section of a portion of the wellscreen assembly in FIG. 4A.

FIGS. 4A-4C illustrate a second embodiment of wellscreen assemblies 100*a-b* similar to those disclosed before in FIGS. 2A-2B and 3A-3C so that like reference numerals are used for comparable elements. In contrast to the previous embodiments, the foils 150 for the permeable gripping sections 107*a-b* do not abut the support rings 116. Instead, the end ring 155 of the foil's secondary filter 151 is spaced in relation relative to the support ring 116.

Figure 5A:
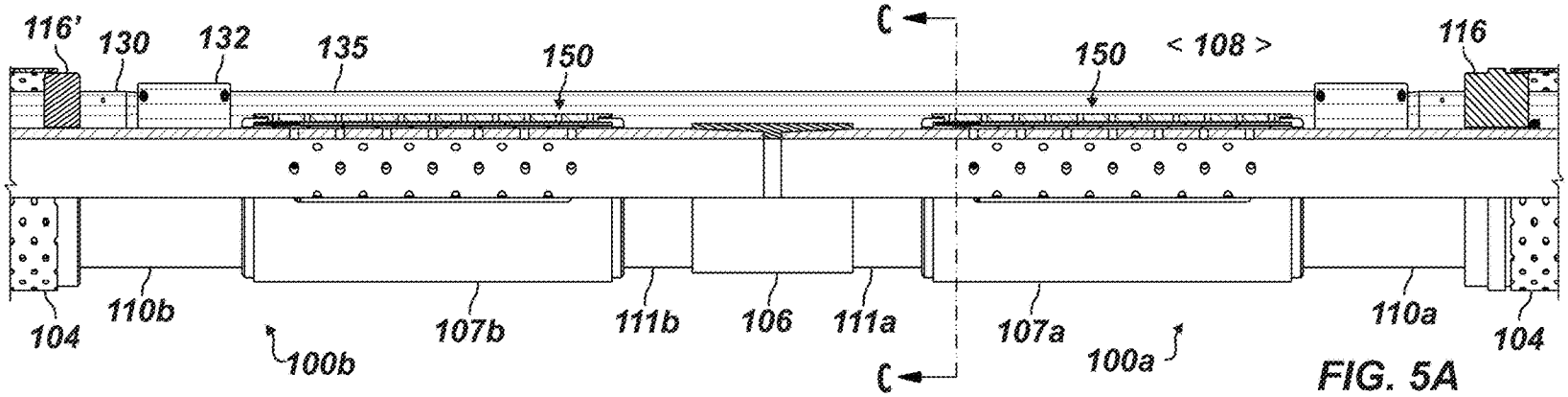
FIG. 5A illustrates a wellscreen assembly according to a third embodiment of the present disclosure in partial cross-section.
Figure 5C:
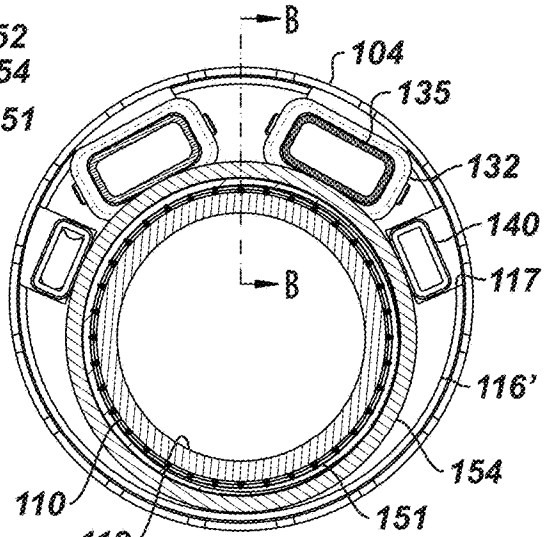
FIG. 5C illustrates an end-section of the wellscreen assembly in FIG. 5A.
Figure 5B:
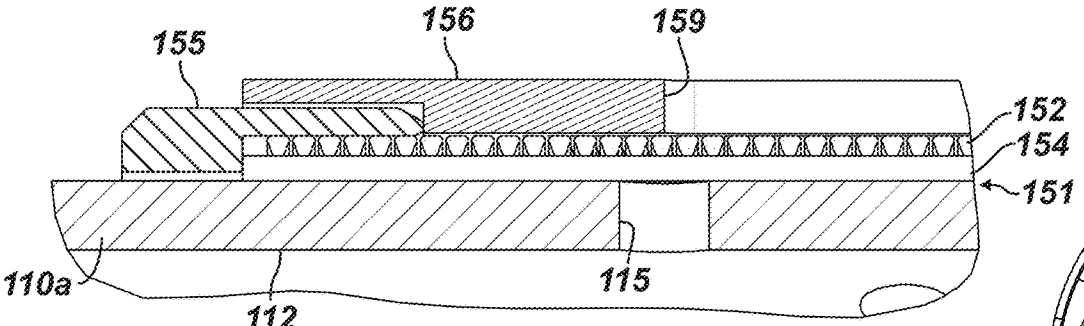
FIG. 5B illustrates a detailed cross-section of a portion of the wellscreen assembly in FIG. 5A.

FIGS. 5A-5C illustrate a third embodiment of wellscreen assemblies 100*a-b* similar to those disclosed in FIGS. 2A-2B, 3A-3C, and 4A-4C so that like reference numerals are used for comparable elements. In contrast to previous embodiments, however, the sleeves 156 of the foils 150 for the permeable gripping sections 107*a-b* include one or more flow openings 159 in the form of elongated slots defined along the sleeve 156. As an example, four such elongated slots 159 can be defined at every 90-degrees about the sleeve 156. More or less of these slots 159 can be used. Compared to the size of gravel and other particulates, these slots 159 can have increased width because filtering is provided by the secondary filter 151 of the foil. Either way, the external surface of the sleeves 156 can provide more gripping area for mechanical grips, slips, jaws, and the like for handling the wellscreen assemblies 100*a-b*.

As discussed above, the foils 150 of FIGS. 3A through 5C have the form of a filter or screen disposed in the blank annular area 108 between the primary screens 120*a-b* of the assemblies 100*a-b*. In these arrangements, the foils 150, which can include a short extent of wire-wrapped screen or filter 151, provide a flow path for the carrier fluid and production fluid to pass through the foils 150 into the bores 112 of the assemblies 100*a-b*. In this way, the foils 150 provide a leak-off path between the assemblies 100*a-b* to screen fluid when used in gravel pack and frac pack operations. Moreover, the foils 150 provide a reinforced tubular sleeve affixed before the basepipes 110*a-b* are made up between the adjoining wellscreen assemblies 100*a-b* for mechanical grips to engage.

Figure 6A:
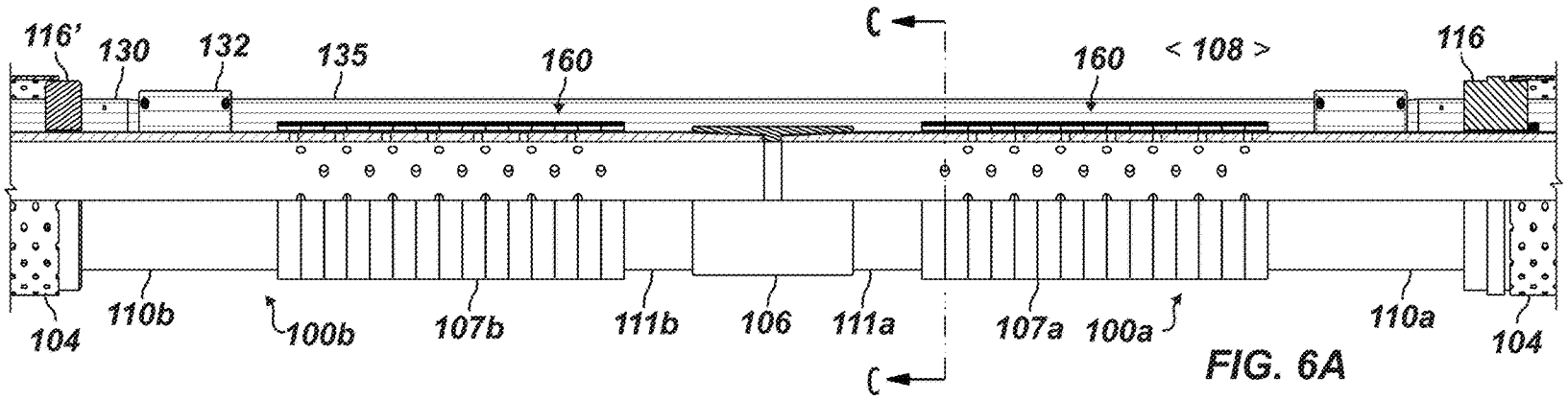
FIG. 6A illustrates a wellscreen assembly according to a fourth embodiment of the present disclosure in partial cross-section.
Figure 6B:
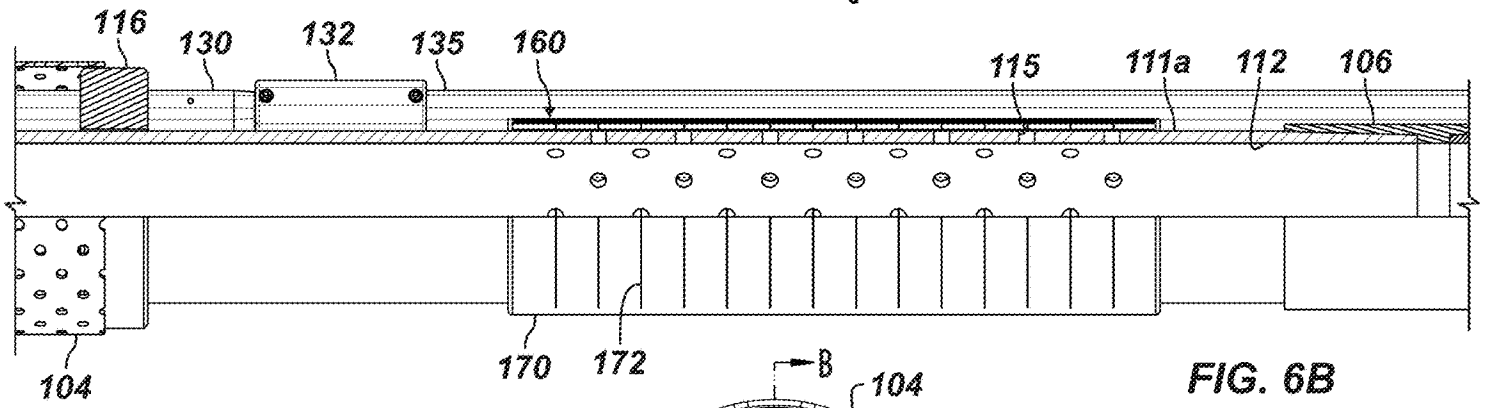
FIG. 6B illustrates a detailed cross-section of a portion of the wellscreen assembly in FIG. 6A.
Figure 6C:
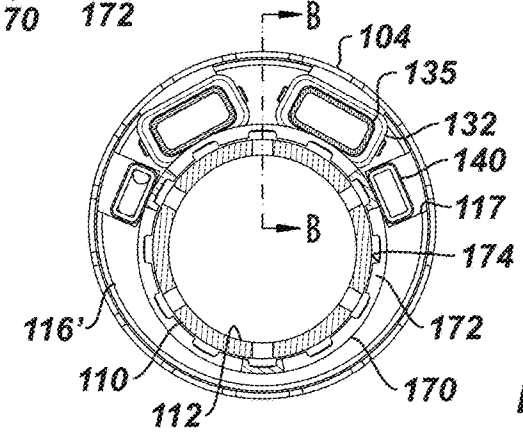
FIG. 6C illustrates an end-section of the wellscreen assembly in FIG. 6A.

FIG. 6A illustrates a fourth embodiment of wellscreen assemblies 100*a-b* according to the present disclosure in partial cross-section. FIG. 6B illustrates a detailed cross-section of a portion of the wellscreen assembly 100*a* in FIG. 6A. FIG. 6C illustrates an end-section of the wellscreen assembly 100*a* in FIG. 6A.

These wellscreen assemblies 100*a-b* are similar to those disclosed previously so that like reference numerals are used for comparable elements. Again, reinforced foils 160 are used for the permeable gripping sections 107*a-b* where leak off fluid can be filtered from the blank annular area 108 between the connected ends 111*a-b* of the basepipes 110*a-b* and where mechanical grips, slips, jaws, etc. (FIG. 2B) can engage and handle the basepipes 110*a-b* during assembly at the rig. As will be appreciated with the benefit of the present disclosure, the foils 160 are suited for the typical gripping and handling forces encountered when handling the wellscreens 100*a-b* and running in hole.

In the present embodiment, the reinforced foils 160 include sleeves 170 disposed on the end 111*a-b* of the basepipe 110*a-b* about the end perforations 115. As shown in FIG. 6B, ends of the sleeve 170 are attached to the basepipe end 111*a* using welds, which can close off the gap between the sleeve 170 and the basepipe end 111*a*. The sleeve 170 defines a set of thin slits 172 formed about the circumference of the sleeve 170 and arranged along the length of the sleeve 170. As shown in FIG. 6C, the sleeve 170 is shown having three slits 172 about the circumference, which encompass less than about 120-degrees each. Other arrangements are possible. The size and width of the slits 172 can be controlled to facilitate dehydration of the slurry during gravel pack. For example, depending on the proppant used in the slurry, the slits 172 can be machined to a slit width of 0.09-in. The angular extent and number of the slits 172 can also be configured to maintain structural integrity of the sleeve 170 for gripping and handling purposes.

The inner circumference of the sleeve 170 can include a plurality of scalloped channels 176 or the like defined longitudinally therealong. These channels 176 can allow fluid to pass between the sleeve 170 and basepipe end 111*a* so the fluid entering through the slits 174 can communicate with the end perforations 115. The channels 176 may not extend to the ends of the sleeves 170. For manufacturing purposes, however, the channels 176 may be formed to extend to the ends of the sleeves 170. Either way, the welds at the end of the sleeve 170 will close off the channels 176 and any annular gap between the sleeve 170 and end 111*a* so that proppant cannot pass.

Figure 7A:
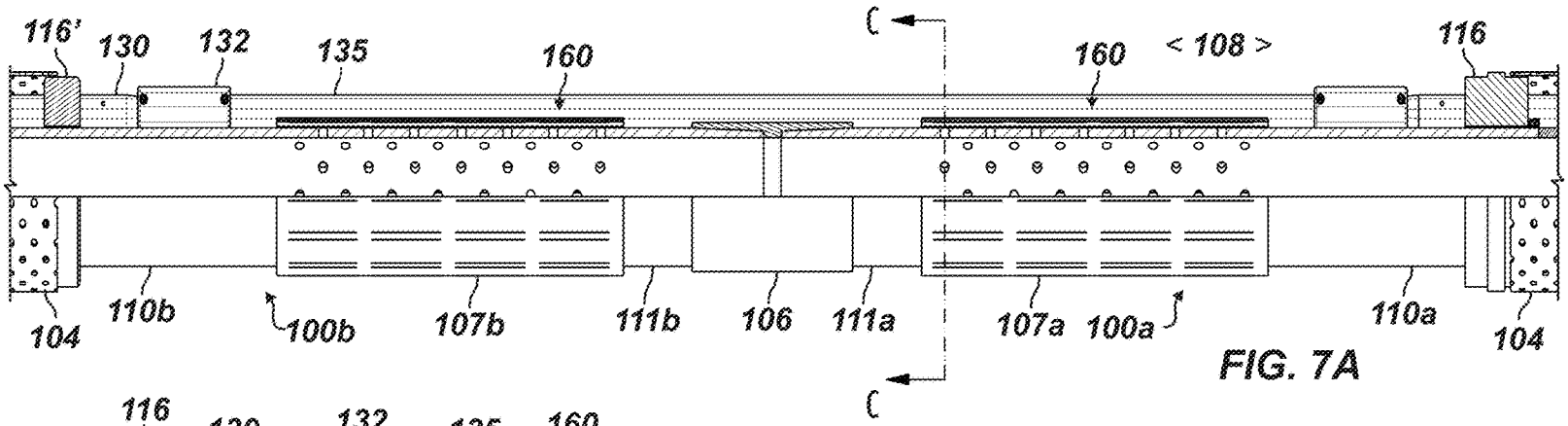
FIG. 7A illustrates a wellscreen assembly according to a fifth embodiment of the present disclosure in partial cross-section.
Figure 7B:
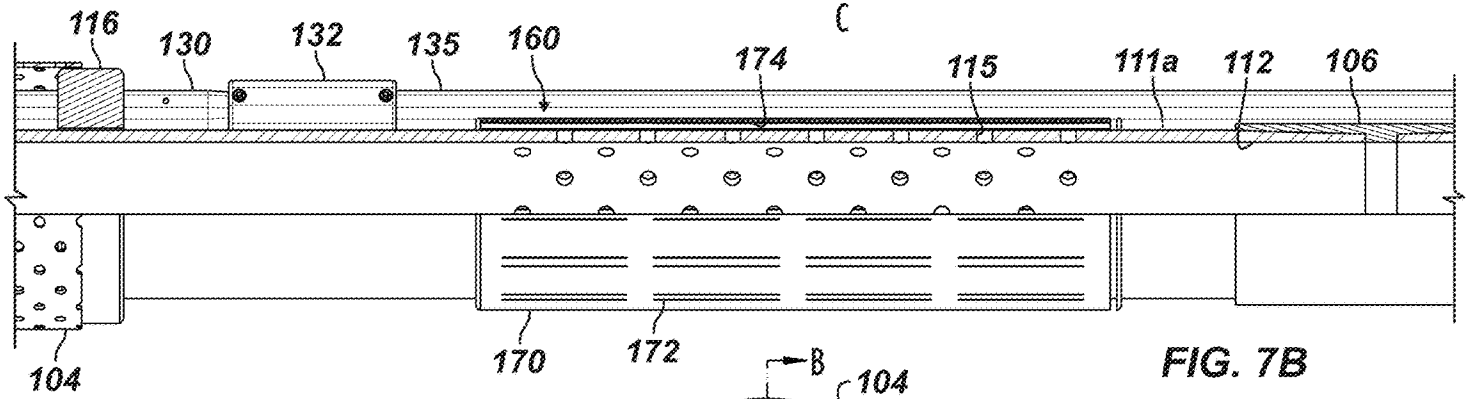
FIG. 7B illustrates a detailed cross-section of a portion of the wellscreen assembly in FIG. 7A.
Figure 7C:
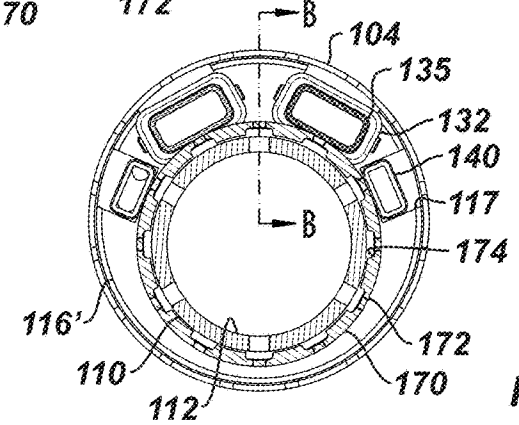
FIG. 7C illustrates an end-section of the wellscreen assembly in FIG. 7A.

FIG. 7A illustrates a fifth embodiment of wellscreen assemblies 100*a-b* according to the present disclosure in partial cross-section. FIG. 7B illustrates a detailed cross-section of a portion of the wellscreen assembly in FIG. 7A. FIG. 7C illustrates an end-section of the wellscreen assembly in FIG. 7A.

These wellscreen assemblies 100*a-b* are similar to those disclosed previously so that like reference numerals are used for comparable elements. Again, reinforced foils 160 are used for the permeable gripping sections 107*a-b* where leak off fluid can be filtered from the blank annular area 108 between the connected ends 111*a-b* of the basepipes 110*a-b* and where mechanical grips, slips, jaws, etc. (FIG. 2B) can engage and handle the pipes 110*a-b* during assembly at the rig.

In the present embodiment, the foils 160 include a sleeve 170 disposed on the end 111*a-b* of the basepipe 110*a-b* about the end perforations 115. The sleeve 170 defines a plurality of flow openings 172 communicating therethrough. As shown in this example, the flow openings 172 can be elongated, thin slits defined longitudinally along the sleeve 170 and arranged about the circumference of the sleeve 170. Other shapes or arrangement of the flow slits 172 could be used. The size and width of the slits 172 can be controlled to facilitate dehydration of the slurry during gravel pack. For example, depending on the proppant used in the slurry, the slits 172 can be machined to a slit width of 0.09-in. The length and number of the slits 172 can also be configured to maintain structural integrity of the sleeve 170 for gripping and handling purposes.

The inner circumference of the sleeve 170 can include a plurality of scalloped channels 176 or the like defined longitudinally therealong. These channels 176 can allow fluid to pass between the sleeve 170 and basepipe end 111*a* so the fluid can communicate with the end perforations 115. The channels 176 may not extend to the ends of the sleeves 170. For manufacturing purposes, the channels 176 may be formed to extend to the ends of the sleeves 170. Either way, the welds at the end of the sleeve 170 will close off the channels 176 and any annular gap between the sleeve 170 and end 111*a* so that proppant cannot pass.

From FIGS. 6A-6C and 7A-7C, it can be seen that the elongated slits 172 can be defined circumferentially about the sleeve 170 or longitudinally along the sleeve 170. Any variation and combination thereof can be used. For example, the slits 172 can be arranged in a helical or spiral about the sleeve 170.

Figure 8A:
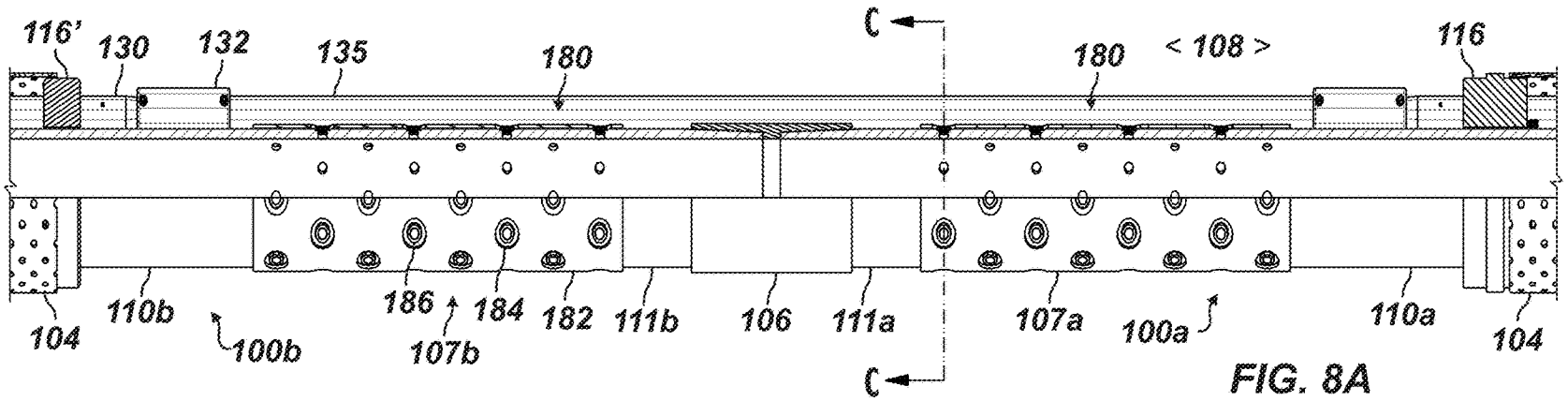
FIG. 8A illustrates a wellscreen assembly according to a sixth embodiment of the present disclosure in partial cross-section.
Figure 8C:
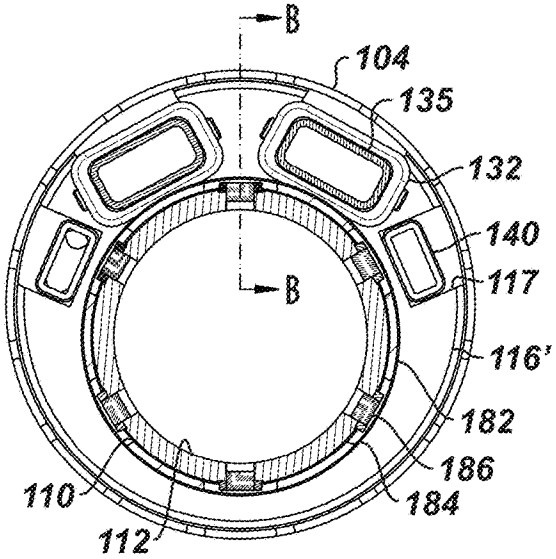
FIG. 8C illustrates an end-section of the wellscreen assembly in FIG. 8A.
Figure 8B:
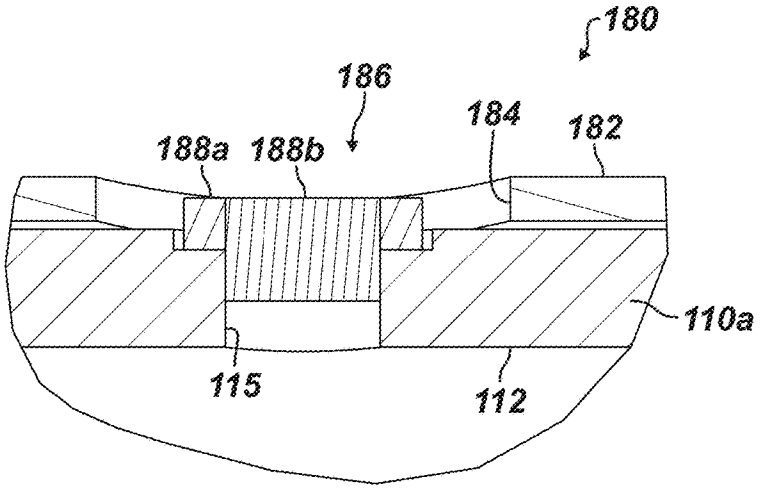
FIG. 8B illustrates a detailed cross-section of a portion of the wellscreen assembly in FIG. 8A.

FIG. 8A illustrates a sixth embodiment of wellscreen assemblies 100*a-b* according to the present disclosure in partial cross-section. FIG. 8B illustrates a detailed cross-section of a portion of the wellscreen assembly in FIG. 8A. FIG. 8C illustrates an end-section of the wellscreen assembly in FIG. 8A.

These wellscreen assemblies 100*a-b* are similar to those disclosed previously so that like reference numerals are used for comparable elements. Again, foils 180 are used for the permeable gripping sections 107*a-b* where leak off fluid can be filtered from the blank annular area 108 between the connected ends 111*a-b* of the basepipes 110*a-b* and where mechanical grips, slips, jaws, etc. (FIG. 2B) can engage and handle the pipes 110*a-b* during assembly at the rig. As will be appreciated with the benefit of the present disclosure, the foils 180 are suited for the typical gripping and handling forces encountered when handling the wellscreens 100*a-b* and running in hole.

In the present embodiment, the foils 180 include a sleeve 182 disposed on the end 111*a-b* of the basepipe 110. For example, the sleeve 182 can have edges welded to the basepipe 110. The sleeve 182 has openings 184 exposed to the end perforations 115. A plurality of plugs 186 are disposed in the end perforations 115 and are exposed to the blank annular area 108 through the openings 184 in the sleeve 182.

Each of the plugs 186 can include a support 188*a* and an insert 188*b*. The support 188*a* is affixed to a surface of the basepipe 110 around the end perforation 115, is affixed in the end perforation 115, is affixed in the exposed openings 184 in the sleeve 182, or is affixed in a combination of these. For example, the support 188*a* can have a threaded or interference fit with the perforation 115, or the support 188*a* can be bonded, welded, etc. to the basepipe 110, perforation 115, or the like. The insert 188*b* is supported in the end perforation 115 by the support 188*a*. The insert 188*b* can include a filter material, mesh, sintered metal, or the like. Either way, the insert 188*b* can provide a secondary filter that allows for leakoff of carrier fluid from the gravel pack slurry so the proppant can dehydrate in the annular blank area 108 during gravel pack operations.

During operations to make up the toolstring and run the wellscreen assemblies 100 of FIGS. 3A through 8C downhole, operators connect the upper basepipe 110*a* to the lower basepipe 110*b* with the coupling 106. The wellscreen assemblies 100*a-b* already have the primary filters 120*a-b*, support rings 116, 116', shrouds 104, transport tubes 130, pack tubes 140, and foils (150, 160, and 180) arranged thereon. Operators tighten the connection of the coupling 106 between the ends 111*a-b* of the basepipes 110*a-b* using the reinforced surfaces of the foils (150, 160, and 180) on the basepipes 110*a-b* for handling and gripping with the grips, slips, and jaws of the devices on the rig.

Once the connection is made, operators then position the jumper tubes (135) and connectors (132) in the blank area 108 to interconnect the shunt tubes 130 between the assemblies 100*a-b*. At this point, any further split cover or shroud can be installed, and the wellscreen assemblies 100*a-b* can be run through the rig floor to set up for the next connection.

Figure 9A:
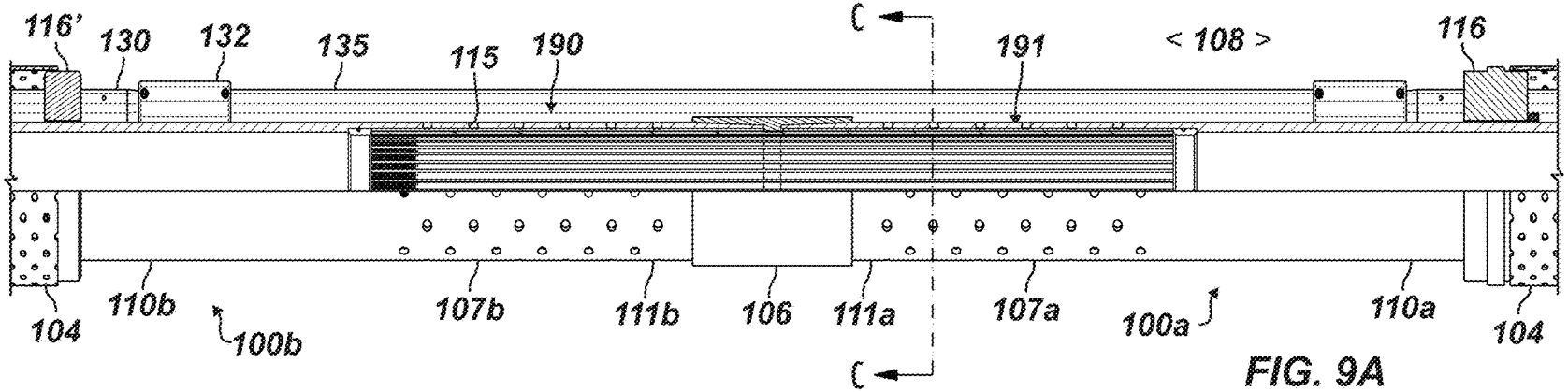
FIG. 9A illustrates a wellscreen assembly according to a seventh embodiment of the present disclosure in partial cross-section.
Figure 9C:
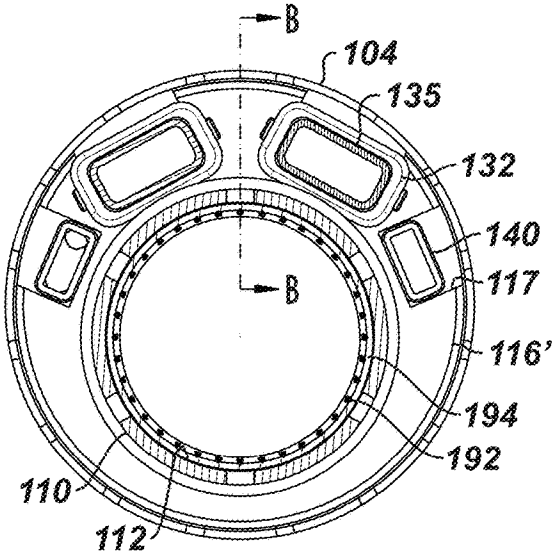
FIG. 9C illustrates an end-section of the wellscreen assembly in FIG. 9A.
Figure 9B:
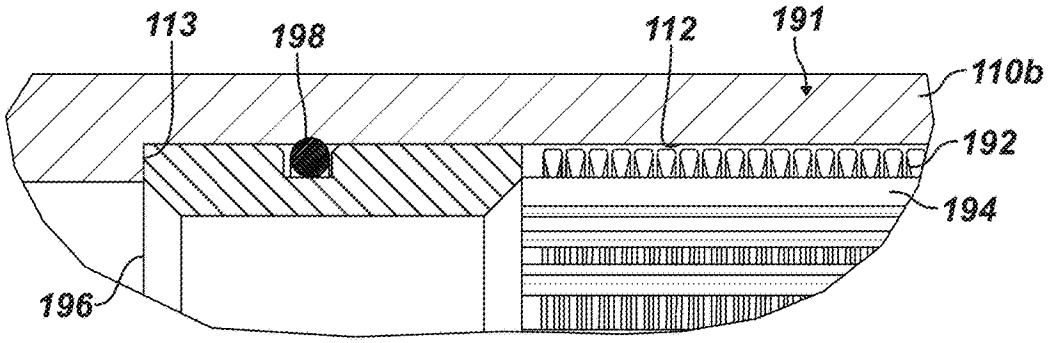
FIG. 9B illustrates a detailed cross-section of a portion of the wellscreen assembly in FIG. 9A.

FIG. 9A illustrates a seventh embodiment of wellscreen assemblies 100*a-b* according to the present disclosure in partial cross-section. FIG. 9B illustrates a detailed cross-section of a portion of the wellscreen assembly 100*a* in FIG. 9A. FIG. 9C illustrates an end-section of the wellscreen assembly 100*a* in FIG. 9A.

These wellscreen assemblies 100*a-b* are similar to those disclosed previously so that like reference numerals are used for comparable elements. Again, a foil 190 is used for the permeable gripping sections 107*a-b* where leak off fluid can be filtered from the blank annular area 108 between the connected ends 111*a-b* of the basepipes 110*a-b* and where mechanical grips, slips, jaws, etc. (FIG. 2B) can engage and handle the pipes 110*a-b* during assembly at the rig.

In the present embodiment, the foil 190 includes a secondary filter 191 disposed inside the bores 112 of the connected basepipes 110*a-b*. The secondary filter 191 can include a wire-wrapped screen having wire 192 wrapped about ribs 194, which are affixed to opposing end sleeves 196. Other types of filter media can be used for the foil 190, such as mesh, etc.

The end sleeves 196 are disposed in the bores 112. Each of the end sleeves 196 is disposed between an end of the secondary filter 191 and a shoulder 113 in the bore 112. The end sleeve 196 can have a seal 198 (e.g., O-ring) for sealing inside the bore 112.

As shown in FIG. 9A, the outer surfaces of the end 111*a-b* of the basepipe 110*a-b* may provide the external surface of the permeable gripping section 107*a-b* used for handling and connecting the basepipes 110*a-b* during assembly. Should additional reinforcement be desired, an external component, such as a sleeve 156, 170, 182 of previous embodiments, can be affixed to the outside of the basepipe 110*a-b* for direct engagement by the mechanical grips, slips, jaws, etc.

To run the wellscreens 100*a-b* of FIGS. 9A-9C into a borehole, a first wellscreen assembly 100*a* is supported at a rig floor. The secondary filter 191 is inserted in the bore 112 for the end 111 of one of the basepipes 110—preferably the first basepipe 110*a* of the wellscreen assembly 100*a* supported at the rig floor. The second wellscreen assembly 100*b* is made up to the first wellscreen assembly 100*a*. For example, the second wellscreen assembly 100*b* is stabbed over the exposed end of the secondary filter 191 extending beyond the coupling 106 already threaded onto the end 111*a* of the wellscreen assembly 100*a*. Then, the end 111*b* of the wellscreen assembly 100*b* can be threaded to the coupling 106.

Mechanical grips, slips, jaws, etc. (FIG. 2B) grip external surfaces of the permeable sections 107*a-b* on the ends 111*a-b* of the basepipes 110*a-b* (or grip any reinforcement component or sleeve), and the connection of the ends 111*a-b* is completed using the gripping. Once the connection is complete, the mechanical gripping is released from the connected ends of the wellscreens 100*a-b* so they can be run through the rig floor. The secondary filter 191 disposed in the bores 112 between the coupled ends 111*a-b* is thereby configured to filter communication from the end perforations 115 on ends of the basepipes 110*a-b* during gravel pack and production operations.

As shown in FIGS. 9A-9C, one secondary filter 191 for the foil 190 can be used to extend between the coupled ends 111*a-b* of the connected assemblies 100*a-b*. Other arrangements are possible in which more than one filter 191 for the foil 190 is used, such as one used in each end of each assembly 100*a-b*. Alternatively, only one of the ends 111*a* of the basepipes 110*a-b* may have the end perforations 115 and only one secondary filter 191 for the foil 190 may be disposed and held in the bore 112 of the one end 111*a-b*.

Figure 10A:
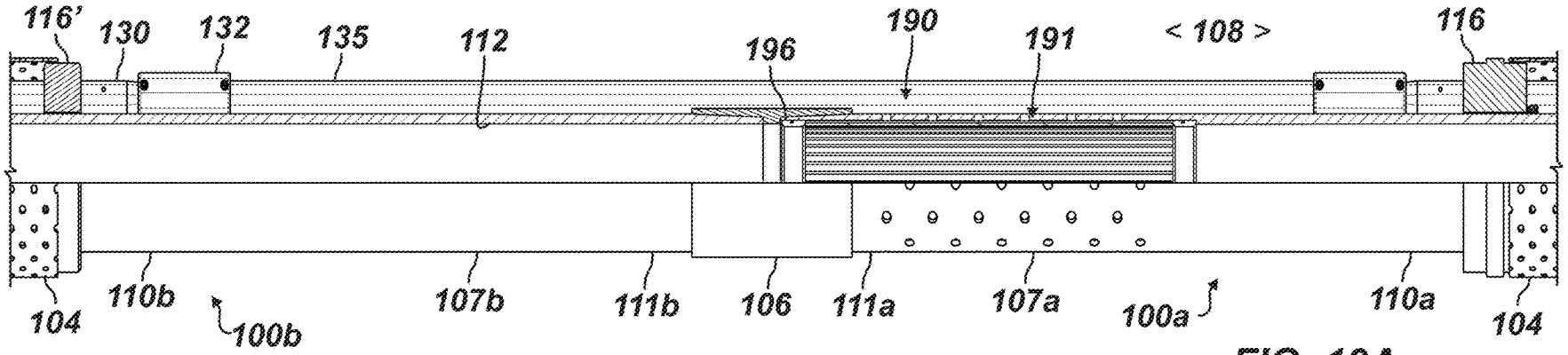
FIGS. 10A-10B illustrate alternative embodiments of a wellscreen as in FIG. 9A.

For example, FIG. 10A illustrates a secondary filter 191 for a foil 190 disposed and held in only one end 111*a* of a basepipe 110*a* that has the end perforations 115. The filter 191 fits in the bore 112 (or a counterbore) in the end 111*a*, and one end sleeve 196 can engage against an internal shoulder 113. Another end sleeve 196 can be arranged at the coupling 106. Such a filter 191 can be preinstalled on the wellscreen assembly 100*a* prior to handling so that the filter 191 would not need to be inserted into the basepipe 110*a* at the rig during make up connections.

Figure 10B:
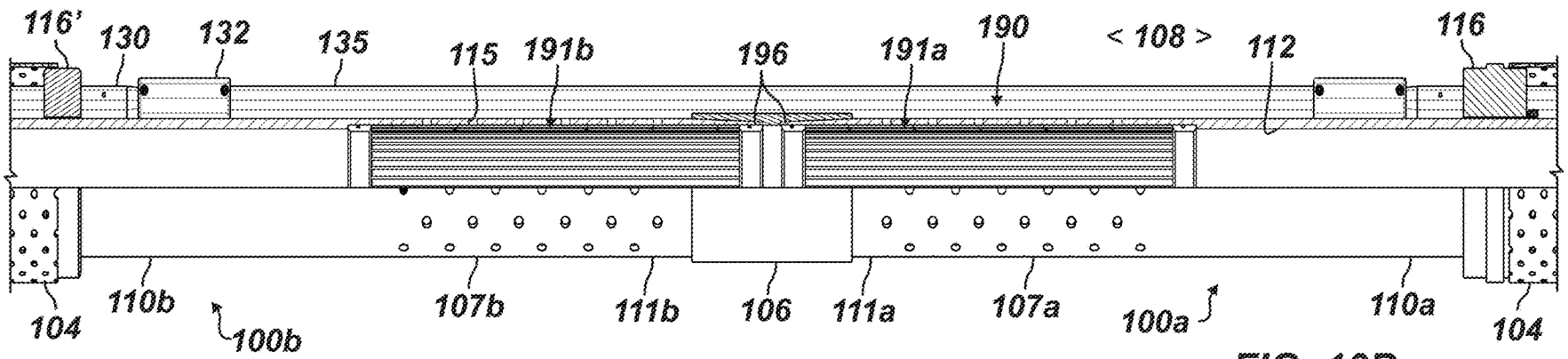

In the other example, FIG. 10B illustrates secondary filters 191*a-b* for a foil 190 disposed and held in both ends 111*a-b* of the basepipes 110*a-b*, which have the end perforations 115. The filters 191*a-b* fit in the bores 112 (or counterbores) in the ends 111*a-b*. For each, one end sleeve 196 can engage against a shoulder 113. Another end sleeve 196 can be arranged at the coupling 106. Such filters 191*a-b* can be preinstalled on the wellscreens 100*a-b* prior to handling so that the filters 191*a-b* would not need to be inserted into the basepipes 110*a-b* at the rig during make up connections. The lower filter 191*a* can be preinstalled and initially held by the coupling 106 already made up to the end 111*a*. The upper filter 191*b* can be installed at the time of make-up and can be held in the end 111*b* at least with some temporary affixing while the end 111*a* is made up to the coupling 106.

As will be appreciated, any of the internal secondary filters 191 for the foils 190 disclosed above may need to float or have some clearance inside the bores (counterbores) between shoulders to avoid buckling when the connections are made up between the basepipes 110*a-b*. Although it may not be necessary, the reinforced sections 107*a-b* of the basepipes 110*a-b* as disclosed herein can be treated with surface hardening or other surface treatment to facilitate the handling disclosed herein.

As disclosed herein, improved open area of the wellscreens provides better dehydration of the gravel pack slurry allowing for a more complete pack of the annulus between the wellbore to the wellscreens. The permeable gripping sections of the present disclosure overcome the problem found in most wellscreens for long horizontal open hole wells, which tend to have significant pipe handling blank section often exceeding 10% of each basepipe or of the entire deployed length. The increasing permeable length of the wellscreens provided by permeable gripping sections of the present disclosure can create a longer effective screen length and can improve productivity of the well or if rate stays the same reduce the risk of erosion.

To do this, the blank non-permeable areas on the wellscreens are converted to permeable areas, in effect maximize the open area or permeable area of the screen joints. At the same time, the permeable gripping sections retain the functionalities of pipe handling while providing additional sand control.

The permeable gripping sections of the wellscreens are made more robust to endure the gripping force and torque of slips, tongs, and the like without damaging the secondary filters or screens. The permeable gripping sections can include a permeable metal sleeve disposed over a screen secured to the basepipe through welded rings, such as end rings. In another method, the handling areas of the basepipe can be perforated with or without a counter sink. Sand retention buttons can then be installed or secured in the perforations to provide sand control while enduring the forces and torques applied during make up or break out of the connection. In yet another method, the handling areas of the basepipes can be perforated and can be machined inside their diameter to retain secondary filters or screens inside the basepipes that provide sand retention capabilities.

Reference to gravel packing herein may equally refer to frack packing. Use of the terms such as screen and filter may be used interchangeably herein. The foregoing description of preferred and other embodiments is not intended to limit or restrict the scope or applicability of the inventive concepts conceived of by the Applicants. For example, although the assemblies 100 disclosed herein have shown use of shunt tubes, it will be appreciated that assemblies can lack shunt tubes and jumper tubes. It will also be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method for running wellscreens from a rig into a borehole, the rig having at least one grip of a rig component, each of the wellscreens having a basepipe with a bore therethrough, each of the wellscreens having a primary filter configured to filter fluid communication with intermediate perforations defined in the basepipe between ends of the basepipe, the method comprising:

supporting a first of the wellscreens at the rig;

making up a second of the wellscreens to the first wellscreen as connected wellscreens at the rig by connecting a first of the ends of the basepipe for the first wellscreen to a second of the ends of the basepipe for the second wellscreen; and passing the connected wellscreens downhole from the rig, wherein at least one of (i) supporting the first wellscreen and (ii) making up the second wellscreen to the first wellscreen comprises gripping the at least one grip of the rig component on a gripping section disposed adjacent end perforations defined in at least one of the ends of at least one of the basepipes, the gripping section having a foil disposed adjacent the end perforations, the foil being configured to filter fluid communication with the end perforations by gripping a sleeve disposed about a secondary filter, the sleeve providing an exterior gripping surface configured to be gripped by the at least one grip, the secondary filter disposed about the end perforations, the sleeve defining a plurality of flow openings configured to communicate with the secondary filter, the secondary filter configured to filter fluid communication with the end perforations.

2. The method of claim 1, wherein supporting the first wellscreen at the rig comprises gripping the at least one grip of the rig component on the gripping section disposed adjacent the end perforations on the first end of the basepipe of the first wellscreen.

3. The method of claim 1, wherein making up the second wellscreen to the first wellscreen comprises gripping the at least one grip of the rig component on the gripping section disposed adjacent the end perforations on the second end of the basepipe of the second wellscreen.

4. The method of claim 1, wherein supporting the first wellscreen comprises gripping the at least one grip of a completion slip the rig component on the gripping section disposed adjacent the end perforations on the first end of the basepipe of the first wellscreen; and wherein making up the second wellscreen to the first wellscreen comprises gripping the at least one grip of a tong device of the rig component on the gripping section disposed adjacent the end perforations on the second end of the basepipe of the second wellscreen.

5. The method of claim 1, wherein making up the second wellscreen to the first wellscreen by connecting the first end of the basepipe for the first wellscreen to the second end of the basepipe for the second wellscreen comprises:

using a coupling configured to couple the first and second ends of the basepipes together; and gripping an exterior gripping surface of the coupling radially exposed to be gripped by the at least one grip of a tong device of the rig component.

6. The method of claim 1, wherein gripping the at least one grip of the rig component on the gripping section disposed adjacent the end perforations on the at least one of the ends of the at least one of the basepipes comprises gripping an exterior gripping surface of the gripping section being radially exposed to be gripped by the grip of at least one of a tong device and a completion slip of the rig component.

7. The method of claim 1, wherein before passing the connected wellscreens downhole from the rig, the method further comprises installing one or more transport tubes to extend along the primary filter between support rings disposed on the ends of each of the basepipes of the wellscreens; and wherein the method further comprises at least one of:

connecting the one or more transport tubes disposed on the second wellscreen to one or more other transport tubes disposed on the first wellscreen by installing one or more jumper tubes across a blank area located at the ends of the basepipes for the connected wellscreens; and installing a shroud about the primary filter and the one or more transport tubes between the support rings on the basepipes of the wellscreens, the shroud defining a plurality of flow openings therethrough.

8. A method for running wellscreens from a rig into a borehole, the rig having at least one grip of a rig component, each of the wellscreens having a basepipe with a bore therethrough, each of the wellscreens having a primary filter configured to filter fluid communication with intermediate perforations defined in the basepipe between ends of the basepipe, the method comprising:

supporting a first of the wellscreens at the rig;

making up a second of the wellscreens to the first wellscreen as connected wellscreens at the rig by connecting a first of the ends of the basepipe for the first wellscreen to a second of the ends of the basepipe for the second wellscreen; and passing the connected wellscreens downhole from the rig, wherein at least one of (i) supporting the first wellscreen and (ii) making up the second wellscreen to the first wellscreen comprises gripping the at least one grip of the rig component on a gripping section disposed adjacent end perforations defined in at least one of the ends of at least one of the basepipes, the gripping section having a foil disposed adjacent the end perforations, the foil being configured to filter fluid communication with the end perforations, by gripping a sleeve disposed on the at least one end of the basepipe about the end perforations, the sleeve providing an exterior gripping surface configured to be gripped by the at least one grip, the sleeve defining a plurality of elongated slits configured to filter fluid communication with the end perforations.

9. The method of claim 8, wherein supporting the first wellscreen comprises gripping the at least one grip of a completion slip the rig component on the gripping section disposed adjacent the end perforations on the first end of the basepipe of the first wellscreen; and wherein making up the second wellscreen to the first wellscreen comprises gripping the at least one grip of a tong device of the rig component on the gripping section disposed adjacent the end perforations on the second end of the basepipe of the second wellscreen.

10. A method for running wellscreens from a rig into a borehole, the rig having at least one grip of a rig component, each of the wellscreens having a basepipe with a bore therethrough, each of the wellscreens having a primary filter configured to filter fluid communication with intermediate perforations defined in the basepipe between ends of the basepipe, the method comprising:

supporting a first of the wellscreens at the rig;

making up a second of the wellscreens to the first wellscreen as connected wellscreens at the rig by connecting a first of the ends of the basepipe for the first wellscreen to a second of the ends of the basepipe for the second wellscreen; and passing the connected wellscreens downhole from the rig, wherein at least one of (i) supporting the first wellscreen and (ii) making up the second wellscreen to the first wellscreen comprises gripping the at least one grip of the rig component on a gripping section disposed adjacent end perforations defined in at least one of the ends of at least one of the basepipes, the gripping section having a foil disposed adjacent the end perforations, the foil the foil being configured to filter fluid communication with the end perforations, by gripping a sleeve disposed on the at least one end of the basepipe, the sleeve providing an exterior gripping surface configured to be gripped by the at least one grip, the sleeve having flow openings exposed to plugs disposed in the end perforations, the plugs being configured to filter fluid communication with the end perforations.

11. The method of claim 10, wherein supporting the first wellscreen comprises gripping the at least one grip of a completion slip the rig component on the gripping section disposed adjacent the end perforations on the first end of the basepipe of the first wellscreen; and wherein making up the second wellscreen to the first wellscreen comprises gripping the at least one grip of a tong device of the rig component on the gripping section disposed adjacent the end perforations on the second end of the basepipe of the second wellscreen.

12. A method of assembling a wellscreen, the method comprising:

installing a primary filter at an intermediate section of a basepipe having a bore therethrough, the primary filter being configured to filter fluid communication with intermediate perforations defined in the intermediate section of the basepipe;

installing a foil adjacent end perforations defined in at least one end section of the basepipe by installing a secondary filter about the end perforations in the at least one end section of the basepipe, the secondary filter of the foil being configured to filter fluid communication with the end perforations; and arranging a gripping section adjacent the at least one end section of the basepipe by installing a sleeve about the secondary filter, the sleeve having an exterior gripping surface for the gripping section, the exterior gripping surface being radially exposed to be gripped by at least one grip of a tong device and a completion slip of a rig component, the sleeve defining a plurality of flow openings configured to communicate with the secondary filter.

13. The method of claim 12, wherein installing the primary filter comprises:

installing support rings on the basepipe; and installing one or more transport tubes to extend along the primary filter of the basepipe between the support rings.

14. The method of claim 12, further comprising running the wellscreen at a rig having the at least one grip of the rig component by at least one of:

supporting the wellscreen at the rig by gripping the at least one grip of the rig component on the gripping section of the wellscreen; and making up the wellscreen to another wellscreen by gripping the at least one grip of the rig component on the gripping section of the wellscreen.

15. A method of assembling a wellscreen, the method comprising:

installing a primary filter at an intermediate section of a basepipe having a bore therethrough, the primary filter being configured to filter fluid communication with intermediate perforations defined in the intermediate section of the basepipe;

installing a foil adjacent end perforations defined in at least one end section of the basepipe by installing a sleeve about the end perforations in the at least one end section of the basepipe, the sleeve defining a plurality of elongated slits configured to filter fluid communication with the end perforations; and arranging a gripping section adjacent the at least one end section of the basepipe by providing an exterior gripping surface of the sleeve radially exposed to be gripped by at least one grip of a tong device and a completion slip of a rig component.

16. The method of claim 15, further comprising running the wellscreen at a rig having the at least one grip of the rig component by at least one of:

supporting the wellscreen at the rig by gripping the at least one grip of the rig component on the gripping section of the wellscreen; and making up the wellscreen to another wellscreen by gripping the at least one grip of the rig component on the gripping section of the wellscreen.

17. A method of assembling a wellscreen, the method comprising:

installing a primary filter at an intermediate section of a basepipe having a bore therethrough, the primary filter being configured to filter fluid communication with intermediate perforations defined in the intermediate section of the basepipe;

installing a foil adjacent end perforations defined in at least one end section of the basepipe by installing a plurality of plugs in the end perforations, the plugs being configured to filter fluid communication with the end perforations; and arranging a gripping section adjacent the at least one end section of the basepipe by installing a sleeve on the at least one end section of the basepipe, the sleeve having flow openings exposed to the end perforations, the sleeve having an exterior gripping surface being radially exposed to be gripped by at least one grip of a tong device and a completion slip of a rig component.

18. The method of claim 17, further comprising running the wellscreen at a rig having the at least one grip of the rig component by at least one of:

supporting the wellscreen at the rig by gripping the at least one grip of the rig component on the gripping section of the wellscreen; and making up the wellscreen to another wellscreen by gripping the at least one grip of the rig component on the gripping section of the wellscreen.

19. A method of assembling a wellscreen, the method comprising:

installing a primary filter at an intermediate section of a basepipe having a bore therethrough, the primary filter being configured to filter fluid communication with intermediate perforations defined in the intermediate section of the basepipe;

installing a foil adjacent end perforations defined in at least one end section of the basepipe by installing a screen longitudinally inside the bore of the basepipe at the at least one end section and abutting an end cap on the screen against a shoulder defined in the bore, the screen of the foil being configured to filter fluid communication with the end perforations; and arranging a gripping section adjacent the at least one end section of the basepipe by providing an exterior gripping surface on the at least one end section of the basepipe for the gripping section, the exterior gripping surface being radially exposed to be gripped by at least one grip of a tong device and a completion slip of a rig component.

20. The method of claim 19, further comprising running the wellscreen at a rig having the at least one grip of the rig component by at least one of:

supporting the wellscreen at the rig by gripping the at least one grip of the rig component on the gripping section of the wellscreen; and making up the wellscreen to another wellscreen by gripping the at least one grip of the rig component on the gripping section of the wellscreen.

* * * * *